US012486999B2

(12) United States Patent
Kang et al.

(10) Patent No.: US 12,486,999 B2
(45) Date of Patent: Dec. 2, 2025

(54) AIR CONDITIONING DEVICE

(71) Applicants: GD MIDEA AIR-CONDITIONING EQUIPMENT CO., LTD., Guangdong (CN); MIDEA GROUP CO., LTD., Guangdong (CN)

(72) Inventors: Tiesheng Kang, Guangdong (CN); Liangrui Chen, Guangdong (CN); Zheng Xu, Guangdong (CN); Xianyou Mao, Guangdong (CN); Hejie Zhou, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 191 days.

(21) Appl. No.: 18/230,779

(22) Filed: Aug. 7, 2023

(65) Prior Publication Data

US 2024/0068696 A1 Feb. 29, 2024

Related U.S. Application Data

(63) Continuation of application No. PCT/CN2021/089300, filed on Apr. 23, 2021.

(30) Foreign Application Priority Data

Feb. 8, 2021 (CN) ..... 202110172390.0
Feb. 8, 2021 (CN) ..... 202120373409.3

(51) Int. Cl.
*F24F 11/74* (2018.01)
*F24F 1/028* (2019.01)

(52) U.S. Cl.
CPC ..... *F24F 11/74* (2018.01); *F24F 1/028* (2019.02)

(58) Field of Classification Search
CPC .. F24F 11/74; F24F 11/89; F24F 1/028; F24F 1/005; F24F 1/0041; F24F 1/0014; F24F 1/0035; F24F 13/10; F24F 13/20
See application file for complete search history.

(56) References Cited

U.S. PATENT DOCUMENTS

2002/0017107 A1 2/2002 Bailey et al.
2024/0210056 A1* 6/2024 Sotokawa ..... F24F 11/74

FOREIGN PATENT DOCUMENTS

CN 204629742 U 9/2015
CN 108488981 A 9/2018
(Continued)

OTHER PUBLICATIONS

CN111189119A Machine Translation. (Year: 2020).*
(Continued)

*Primary Examiner* — Marc E Norman
(74) *Attorney, Agent, or Firm* — Scully, Scott, Murphy & Presser, P.C.

(57) ABSTRACT

An air conditioning device is provided. The device has a fresh air component and a control valve assembly. The fresh air component has a housing assembly and an air treatment assembly. The housing assembly has a ventilation cavity, a fresh air cavity and an exhaust cavity. The air treatment assembly is disposed in the exhaust cavity. The control valve assembly has a first valve assembly and a second valve assembly, which are independent of each other. An outlet of the ventilation cavity is in communication with an indoor space through the exhaust cavity and an air outlet when the first valve assembly is in an open state. The outlet of the ventilation cavity is in communication with the fresh air cavity when the second valve assembly is in an open state.

17 Claims, 12 Drawing Sheets

(56) References Cited

FOREIGN PATENT DOCUMENTS

| | | | | |
|---|---|---|---|---|
| CN | 111189119 | A | | 5/2020 |
| CN | 210624821 | U | | 5/2020 |
| CN | 210624823 | U | | 5/2020 |
| CN | 111486512 | A | | 8/2020 |
| CN | 211977020 | U | | 11/2020 |
| CN | 212204781 | U | | 12/2020 |
| CN | 212319915 | U | | 1/2021 |
| CN | 212378181 | U | | 1/2021 |
| CN | 213272899 | U | * | 5/2021 |
| CN | 214249964 | U | | 9/2021 |
| CN | 214791496 | U | | 11/2021 |
| CN | 114909754 | A | * | 8/2022 |
| EP | 3150943 | A1 | | 4/2017 |
| JP | H10122596 | A | | 5/1998 |
| KR | 20180050814 | A | | 5/2018 |

OTHER PUBLICATIONS

International Search Report dated Nov. 9, 2021 issued in PCT/CN2021/089300.
Supplementary European search report dated Jun. 25, 2024 received in European Patent Application No. 21924007.4.
Written Opinion dated Nov. 9, 2021 received in International Application No. PCT/CN2021/089300.
First Office Action dated Nov. 25, 2024 received in Chinese Patent Application No. 202110172390.0.

* cited by examiner

AIR CONDITIONING DEVICE

CROSS-REFERENCE TO RELATED APPLICATIONS

The present application is a continuation application of PCT International Application No. PCT/CN2021/089300, filed on Apr. 23, 2021, which claims priority to Chinese Patent Application Nos. 202110172390.0 and No. 202120373409.3, both filed on Feb. 8, 2021, the entire disclosure of each of which are incorporated herein by reference. No new matter has been introduced.

FIELD

The present disclosure relates to the field of air conditioning technologies, and more particularly, to an air conditioning device.

BACKGROUND

Some air conditioners in the related art have a fresh air function. When outdoor air is fresh and indoor air is stale, the fresh air function may be activated to introduce the outdoor air into an indoor space. However, the stale indoor air continues to be present in the indoor space, resulting in non-significant improvement in air quality.

SUMMARY

The present disclosure aims to solve at least one of the technical problems in the related art. To this end, the present disclosure is to provide an air conditioning device. The air conditioning device can be switched to discharge indoor stale air to an outdoor space and performing circulation treatment on the indoor stale air.

An air conditioning device according to an embodiment of the present disclosure includes an air outlet, a fresh air component, and a control valve assembly. The air outlet is adapted to be in communication with an indoor space. The fresh air component includes a housing assembly and an air treatment assembly. The housing assembly has a ventilation cavity, a fresh air cavity adapted to be in communication with an outdoor space, and an exhaust cavity adapted to be in communication with the air outlet. The ventilation cavity has an inlet adapted to be in communication with the outdoor space and/or the indoor space and an outlet adapted to be in communication with the exhaust cavity and the fresh air cavity. The air treatment assembly is disposed in the exhaust cavity. The control valve assembly includes a first valve assembly and a second valve assembly that are independent of each other. The outlet of the ventilation cavity is in communication with the indoor space through the exhaust cavity and the air outlet when the first valve assembly is in an open state, and the outlet of the ventilation cavity is in communication with the fresh air cavity when the second valve assembly is in an on open state.

The air conditioning device according to the present disclosure can be switchable between functions such as discharging indoor stale air to an outdoor space and performing circulation treatment on the indoor stale air. In addition, since the first valve assembly and the second valve assembly are independent of each other, they do not interface with each other in arrangement positions and actions, allowing for a flexible design of the air conditioning device.

In some embodiments, the inlet of the ventilation cavity is adapted to be in communication with the outdoor space through the fresh air cavity. The control valve assembly further includes a third valve assembly, and the inlet of the ventilation cavity is in communication with the fresh air cavity when the third valve assembly is in an open state.

In some embodiments, the fresh air cavity is located at a rear side of the ventilation cavity. The third valve assembly is disposed between a front of the fresh air cavity and a rear of the ventilation cavity, and includes a plurality of first vertical baffles sequentially arranged in a left-right direction. Each of the plurality of first vertical baffles is pivotally connected to the housing assembly.

In some embodiments, the first valve assembly includes a downstream control valve arranged downstream of the air treatment assembly.

In some embodiments, the downstream control valve is disposed at the air outlet, and is configured to control opening or closing of the air outlet.

In some embodiments, the downstream control valve includes a plurality of second vertical baffles sequentially arranged in a transverse direction of the air outlet.

In some embodiments, the first valve assembly includes an upstream control valve arranged upstream of the air treatment assembly.

In some embodiments, the upstream control valve is located below the air treatment assembly and includes a plurality of first transverse baffles sequentially arranged in a front-rear direction. Each of the plurality of first transverse baffles is pivotally connected to the housing assembly.

In some embodiments, the fresh air cavity is located at a rear side of the ventilation cavity. The exhaust cavity is located above the ventilation cavity. The ventilation cavity includes an upper cavity. A top of the upper cavity is in communication with the exhaust cavity through a first outlet, and a rear of the upper cavity is in communication with an upper part of the fresh air cavity through a second outlet. The second valve assembly is disposed at the second outlet, and is configured to control opening or closing of the second outlet.

In some embodiments, the second valve assembly includes a second transverse baffle pivotally connected to the housing assembly.

In some embodiments, a centrifugal fan is disposed in the ventilation cavity.

In some embodiments, the air conditioning device further has a return air inlet adapted to be in communication with the indoor space. The control valve assembly further includes a fourth valve assembly. The inlet of the ventilation cavity is in communication with the indoor space through the return air inlet when the fourth valve assembly is in an open state.

In some embodiments, the fourth valve assembly is disposed at the return air inlet, and is configured to control opening or closing of the return air inlet.

In some embodiments, the fresh air component further includes a fresh air pipe having an end defining a fresh air inlet and another end in communication with the fresh air cavity. The control valve assembly further includes a fifth valve assembly disposed at the fresh air pipe. The fresh air cavity is in communication with the outdoor pace through the fresh air pipe when the fifth valve assembly is in an open state.

In some embodiments, an accessible opening is formed on a surface of the housing assembly. The air treatment assembly includes at least one treatment module adapted to be inserted into the exhaust cavity through the accessible opening.

In some embodiments, the housing assembly includes an upper housing assembly and a lower housing assembly. The upper housing assembly is assembled above the lower housing assembly and defines the exhaust cavity. The lower housing assembly defines the ventilation cavity and the fresh air cavity. The upper housing includes an upper housing and a lower housing. The upper housing is provided above the lower housing. The air treatment assembly is mounted in the lower housing. An indoor air outlet is formed on a front part of each of a left side wall and a right side wall of the upper housing and is adapted to communicate the indoor space and the exhaust cavity.

In some embodiments, the air conditioning device is an air conditioner and further includes an air heat exchanger configured for temperature adjustment.

In some embodiments, the air conditioning device further includes a casing component. The air heat exchanger and the fresh air component are both received in the casing component. The air outlet and a return air inlet adapted to be in communication with the indoor space are formed on the casing component. The housing assembly has an indoor return air inlet in communication with the return air inlet and an indoor air outlet in communication with the air outlet. The first valve assembly includes a downstream control valve mounted on the casing component and configured to control opening or closing of the air outlet. The second valve assembly is mounted on the casing component.

Additional aspects and advantages of the present disclosure will be provided at least in part in the following description, or will become apparent at least in part from the following description, or can be learned from practicing of the present disclosure.

Figure 1:
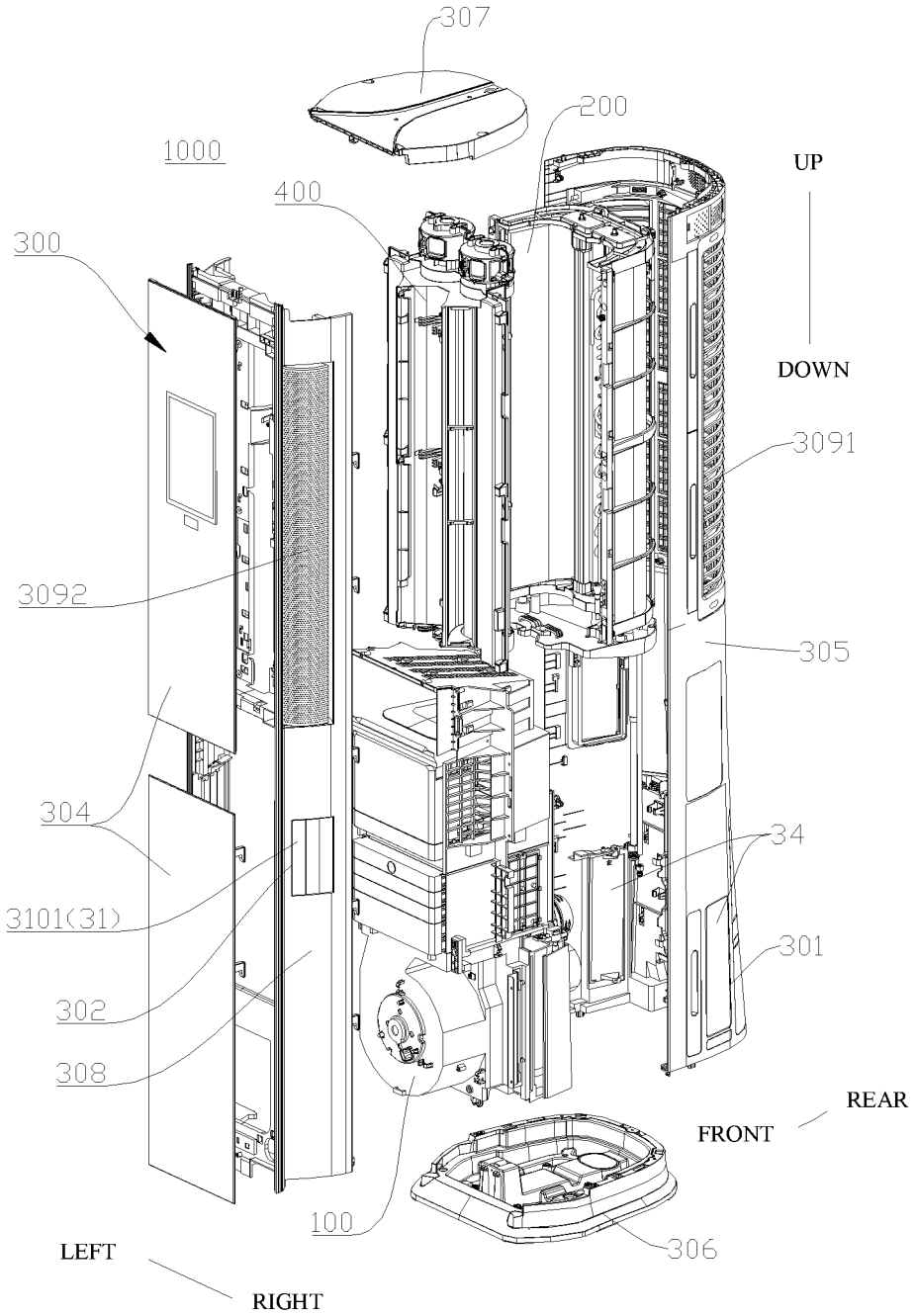
FIG. 1 is an exploded view of an air conditioning device according to an embodiment of the present disclosure.

REFERENCE NUMERALS air conditioning device 1000;

fresh air component 100;

housing assembly 1; ventilation cavity 101; front cavity 1011; rear cavity 1012; upper cavity 1013; first inlet 101*a*; second inlet 101*b*; first outlet 101*c*; second outlet 101*d*; fresh air cavity 102; exhaust cavity 103; mounting portion 1030; first mounting space 1031; second mounting space 1032; outdoor fresh air inlet 104; indoor return air inlet 105; indoor air outlet 106; first opening 107; second opening 108; third opening 109;

upper housing assembly 11; upper housing 111; lower housing 112; accessible opening 113;

lower housing assembly 12; first housing 121; second housing 122; third housing 123; fourth housing 124;

fan assembly 2; centrifugal fan 21; drive motor 22;

first valve assembly 31; downstream control valve 3101; first driver 311; second vertical baffle 313; upstream control valve 3102; first transverse baffle 312;

second valve assembly 32; second driver 321; second transverse baffle 322;

third valve assembly 33; third connection rod 332; first vertical baffle 333;

fourth valve assembly 34; fifth valve assembly 35;

air treatment assembly 4; treatment module 40; first module 401; second module 402;

fresh air pipe 5;

air heat exchanger 200;

casing component 300; return air inlet 301; air outlet 302; fresh air inlet 303;

front panel 304; rear casing 305; bottom casing 306; top casing 307; air outflowing grille 308;

heat exchange air inlet 3091; heat exchange air outlet 3092;

air duct component 400.

DETAILED DESCRIPTION

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting the present disclosure.

Various embodiments or examples for implementing different structures of the present disclosure are provided below. In order to simplify the description of the present disclosure, components and configurations of specific examples are described below. These specific examples are merely for the purpose of illustration, rather than limiting the present disclosure. Further, the same reference numerals and/or reference letters may appear in different examples of the present disclosure for the purpose of simplicity and clarity, instead of indicating a relationship between different embodiments and/or the discussed configurations. In addition, the present disclosure provides examples of various specific processes and materials. However, applications of other processes and/or the use of other materials are conceivable for those of ordinary skill in the art.

An air conditioning device 1000 according to embodiments of the present disclosure will be described below with reference to the drawings.

Figure 2:
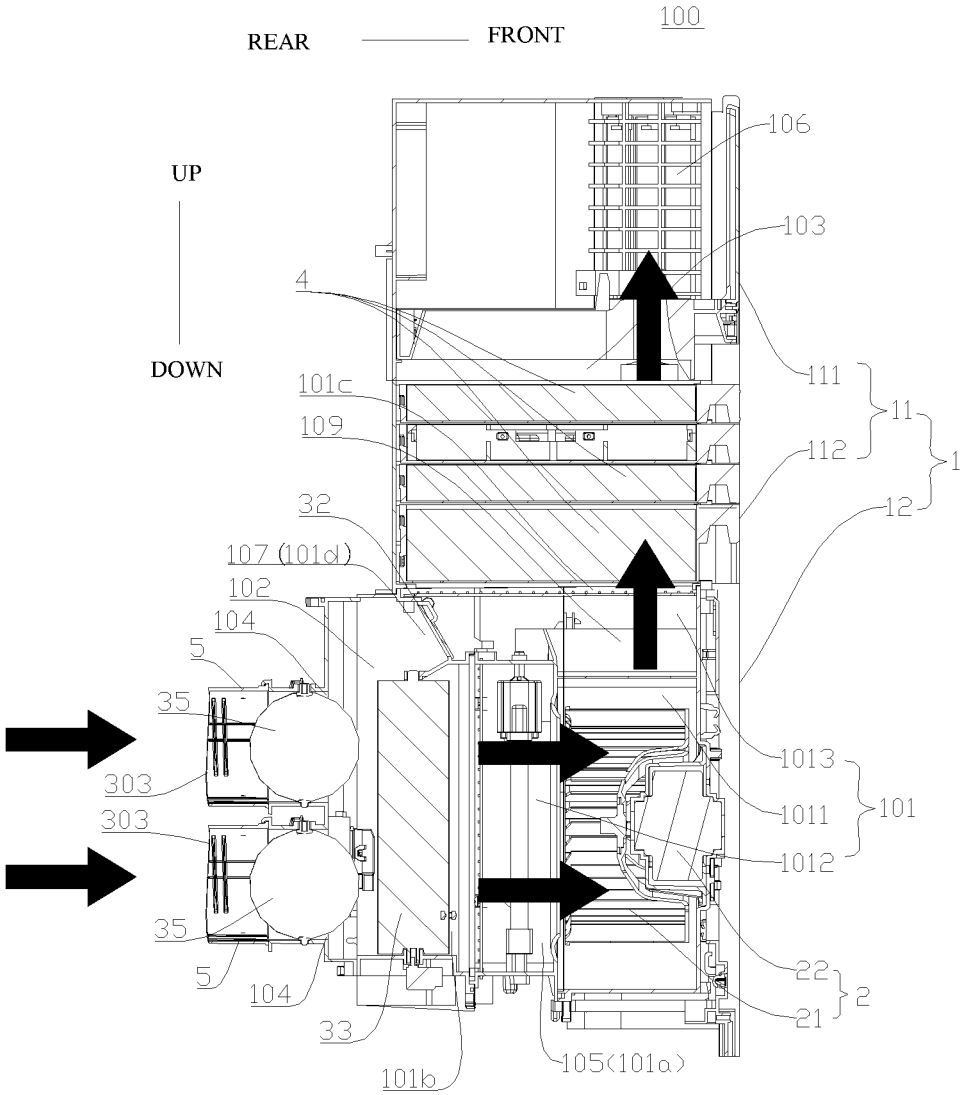
FIG. 2 is a cross-sectional view of a fresh air component illustrated in FIG. 1 under a fresh air function.

As illustrated in FIG. 1 and FIG. 2, the air conditioning device 1000 may include a fresh air component 100. The fresh air component 100 may include a housing assembly 1. The housing assembly 1 has a ventilation cavity 101. When a pressure at an outlet of the ventilation cavity 101 is smaller than a pressure at an inlet of the ventilation cavity 101, air outside the ventilation cavity 101 may enter the ventilation cavity 101 through an inlet of the ventilation cavity 101. Further, the air entering the ventilation cavity 101 may flow from the inlet of the ventilation cavity 101 towards the outlet of the ventilation cavity 101, and then is discharged from the ventilation cavity 101 through the outlet of the ventilation cavity 101.

As illustrated in FIG. 1 and FIG. 2, the housing assembly 1 may further have a fresh air cavity 102. The fresh air cavity 102 is adapted to be in direct or indirect communication with outside. When an air pressure in the fresh air cavity 102 is smaller than an air pressure of an outdoor environment, outdoor air may enter the fresh air cavity 102. When the air pressure in the fresh air cavity 102 is greater than the air pressure of outside, air in the fresh air cavity 102 may be discharged outside.

As illustrated in FIG. 1 and FIG. 2, the air conditioning device 1000 may have an air outlet 302. The air outlet 302 is adapted to be in communication with an indoor space, enabling the air conditioning device 1000 to discharge the air to the indoor space through the air outlet 302. The air outlet 302 may be formed or not formed at the housing assembly 1. As illustrated in FIG. 1 and FIG. 2, the housing assembly 1 may further have an exhaust cavity 103. The exhaust cavity 103 is adapted to be in direct or indirect communication with the air outlet 302. When the air outlet 302 is in communication with both the indoor space and the exhaust cavity 103, the exhaust cavity 103 may discharge the air into the indoor space through the air outlet 302 when an air pressure in the exhaust cavity 103 is greater than an air pressure of an indoor environment.

Figure 3:
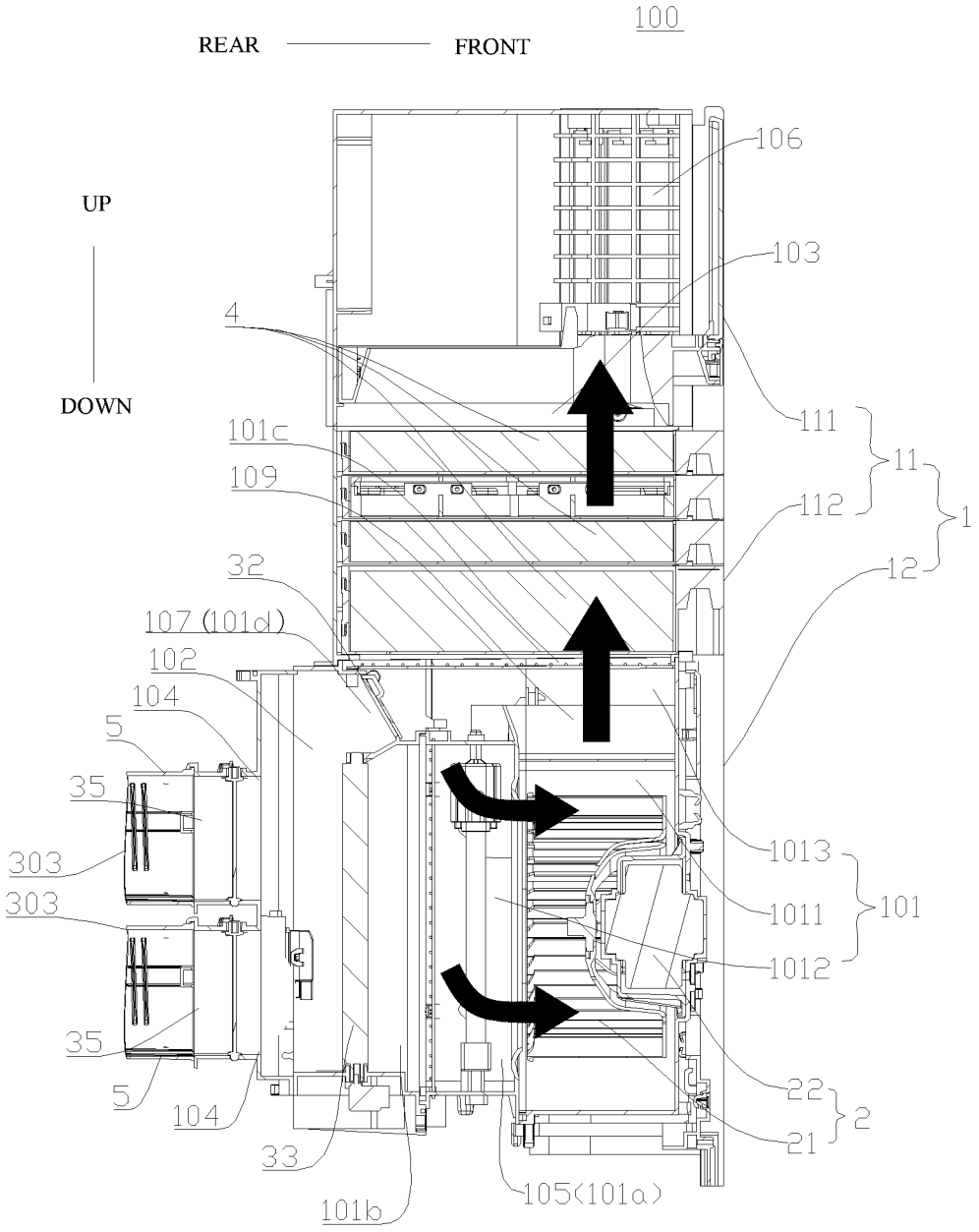
FIG. 3 is a cross-sectional view of a fresh air component illustrated in FIG. 1 under an internal circulation function.

As illustrated in FIG. 3, the inlet of the ventilation cavity 101 (a first inlet 101*a* as illustrated in FIG. 3) is adapted to be in direct or indirect communication with the indoor space. When the inlet of the ventilation cavity 101 is in communication with the indoor space, indoor air may enter the ventilation cavity 101 through the first inlet 101*a* when an air pressure in the ventilation cavity 101 is smaller than the air pressure of the indoor environment.

As illustrated in FIG. 2, the inlet of the ventilation cavity 101 (a second inlet 101*b* as illustrated in FIG. 2) is adapted to be in direct or indirect communication with the outdoor space. When the inlet of the ventilation cavity 101 is in communication with the outdoor space, the outdoor air may enter the ventilation cavity 101 through the second inlet 101*b* when the air pressure in the ventilation cavity 101 is smaller than the air pressure of the outdoor environment.

As illustrated in FIG. 3, the outlet of the ventilation cavity 101 (a first outlet 101*c* as illustrated in FIG. 3) is adapted to be in direct or indirect communication with the exhaust cavity 103. When the exhaust cavity 103 is in communication with both the indoor space and the outlet of the ventilation cavity 101, the ventilation cavity 101 may discharge the air indoors through the exhaust cavity 103 when the air pressure in the ventilation cavity 101 is greater than the air pressure of the indoor environment.

Figure 4:
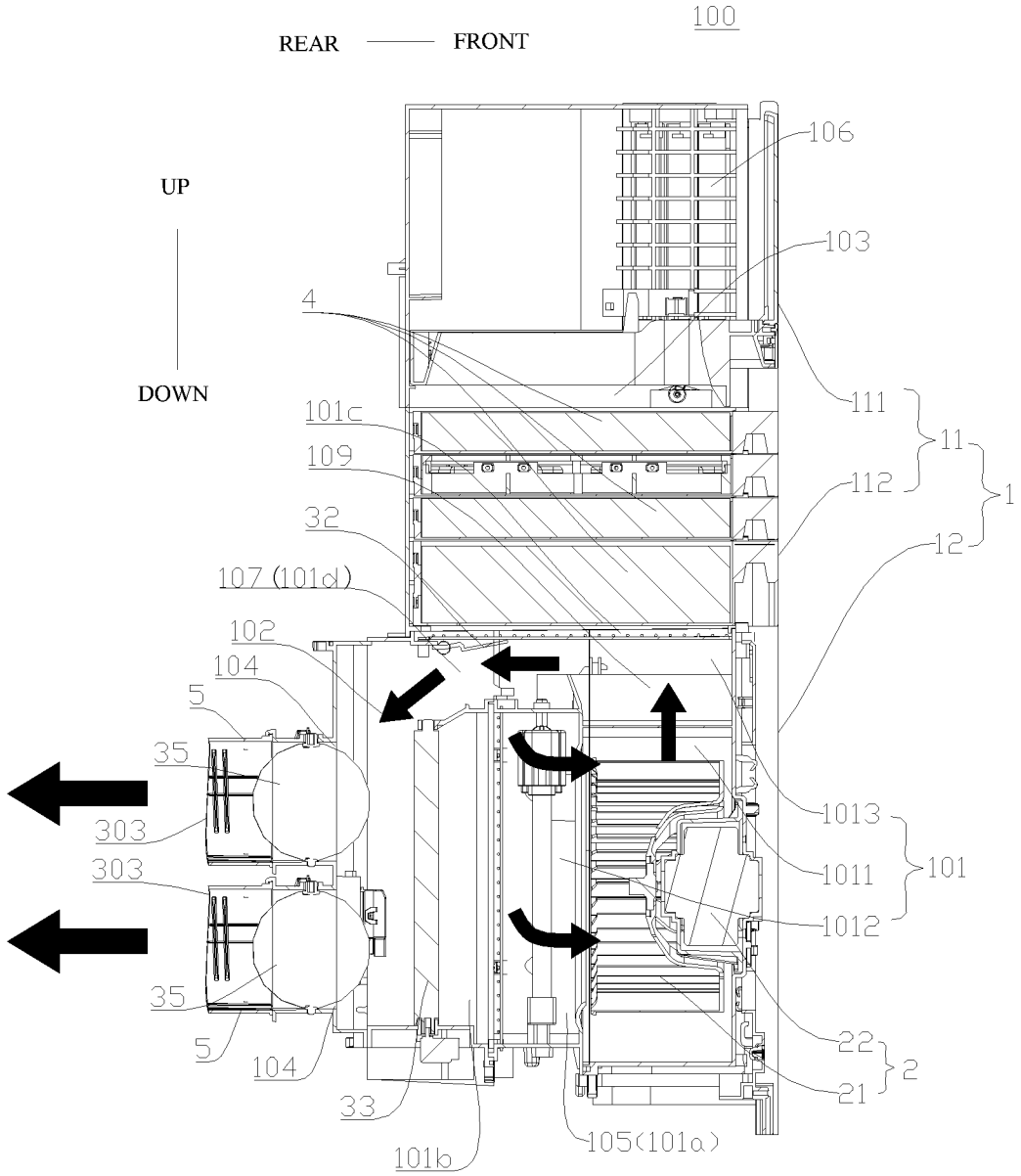
FIG. 4 is a cross-sectional view of a fresh air component illustrated in FIG. 1 under an exhaust function.

As illustrated in FIG. 4, the outlet of the ventilation cavity 101 (a second outlet 101*d* as illustrated in FIG. 3) is adapted to be in direct or indirect communication with the fresh air cavity 102. When the fresh air cavity 102 is in communication with both the outdoor space and the outlet of the ventilation cavity 101, the ventilation cavity 101 may discharge the air into the outdoor space through the fresh air cavity 102 when the air pressure in the ventilation cavity 101 is greater than the air pressure of the outdoor environment.

In an example of the present disclosure, as illustrated in FIGS. 2 to 4, the ventilation cavity 101 may have two inlets including a first inlet 101*a* and a second inlet 101*b*. The ventilation cavity 101 may further have two outlets including a first outlet 101*c* and a second outlet 101*d*. The first inlet 101*a* is adapted to be in communication with the indoor space. The second inlet 101*b* is adapted to be in communication with the fresh air cavity 102. The first outlet 101*c* is adapted to be in communication with the exhaust cavity 103. The second outlet 101*d* is adapted to be in communication with the fresh air cavity 102.

As illustrated in FIG. 2 to FIG. 4, the fresh air component 100 may include an air treatment assembly 4. The air treatment assembly 4 is disposed in the exhaust cavity 103. When an airflow enters the exhaust cavity 103 and flows through the air treatment assembly 4, the airflow may be treated by the air treatment assembly 4. Therefore, quality of the air discharged from the exhaust cavity 103 can be ensured.

As illustrated in FIG. 1 and FIG. 2, the air conditioning device 1000 may include a control valve assembly. The control valve assembly may be disposed or not disposed in the housing assembly 1. The control valve assembly may include a first valve assembly 31 and a second valve assembly 32. The first valve assembly 31 and the second valve assembly 32 are independent of each other. That is, the first valve assembly 31 and the second valve assembly 32 are different valve banks and are independently controlled.

As illustrated in FIG. 1 and FIG. 2, the outlet of the ventilation cavity 101 is in communication with the indoor space through the exhaust cavity 103 and the air outlet 302 when the first valve assembly 31 is in an open state. In some embodiments, the first valve assembly 31 is switchable between an open state and a close state. As illustrated in FIG. 2 and FIG. 3, when the first valve assembly 31 is in the open state and the pressure in the ventilation cavity 101 is greater than indoor pressure, the ventilation cavity 101 may discharge the air from the air outlet 302 into the indoor space through the exhaust cavity 103. As illustrated in FIG. 4, when the first valve assembly 31 is in the close state, even if the pressure in the ventilation cavity 101 is greater than the indoor pressure, the ventilation cavity 101 cannot discharge the air from the air outlet 302 to the indoor space through the exhaust cavity 103. For example, the ventilation cavity 101 cannot discharge the air to the exhaust cavity 103. In some embodiments, although the ventilation cavity 101 can discharge the air to the exhaust cavity 103, the exhaust cavity 103 cannot discharge the air into the indoor space through the air outlet 302. In some embodiments, the ventilation cavity 101 cannot discharge the air to the exhaust cavity 103, and cannot discharge the air into the indoor space through the air outlet 302.

As illustrated in FIG. 4, the outlet of the ventilation cavity 101 is in communication with the fresh air cavity 102 when the second valve assembly 32 is in an open state. In some embodiments, the second valve assembly 32 is switchable between the open state and a close state. As illustrated in FIG. 4, when the second valve assembly 32 is in the open state and the pressure in the ventilation cavity 101 is greater than the pressure in the fresh air cavity 102, the ventilation cavity 101 can discharge the air to the fresh air cavity 102. As illustrated in FIG. 1 and FIG. 2, when the second valve assembly 32 is in the close state, the ventilation cavity 101 cannot discharge the air to the fresh air cavity 102 even if the pressure in the ventilation cavity 101 is greater than the pressure in the fresh air cavity 102.

Therefore, the air treatment device 1000 according to the embodiment of the present disclosure may have at least three operation modes.

In a first operation mode, as illustrated in FIG. 2, the first valve assembly 31 is in the open state, and the second valve assembly 32 is in the close state. When the air is sucked through the inlet of the ventilation cavity 101 from the outdoor space and the pressure at the outlet of the ventilation cavity 101 is smaller than the pressure at the inlet of the ventilation cavity 101, outdoor fresh air will enter the ventilation cavity 101, then is discharged into the exhaust cavity 103 from the ventilation cavity 101. Then, the air is discharged into the indoor space through the air outlet 302 after treated by the air treatment assembly 4. Therefore, a fresh air function of introducing the outdoor fresh air into the indoor space from the outdoor space can be achieved.

In a second operation mode, as illustrated in FIG. 3, the first valve assembly 31 is in the open state, and the second valve assembly 32 is in the close state. When the air is sucked through the inlet of the ventilation cavity 101 from the indoor space, and the pressure at the outlet of the ventilation cavity 101 is smaller than the pressure at the inlet of the ventilation cavity 101, the indoor air will enter the ventilation cavity 101, and then is discharged to the exhaust cavity 103 from the ventilation cavity 101. Then, the air is discharged into the indoor space through the air outlet 302 after treated by the air treatment assembly 4. Therefore, an internal circulation function of introducing the air from the indoor space to be treated and discharging the treated air into the indoor space can be realized.

In a third operation mode, as illustrated in FIG. 4, the first valve assembly 31 is in the close state, and the second valve assembly 32 is in the open state. When the air is sucked through the inlet of the ventilation cavity 101 from the indoor space, the fresh air cavity 102 may discharge the air into the outdoor space, and the pressure at the outlet of the ventilation cavity 101 is smaller than the pressure at the inlet of the ventilation cavity 101, the indoor air will enter the ventilation cavity 101, and then is discharged to the fresh air cavity 102 from the ventilation cavity 101. Then, the air is discharged into the outdoor space through the fresh air cavity 102. Therefore, an exhaust function of introducing the air from the indoor space and discharging the air into the outdoor space can be realized to discharge the stale air into the outdoor space.

Under the fresh air function, a path along which the airflow flows through the housing assembly 1 is referred to as a fresh air channel. Under the internal circulation function, a path along which the airflow flows through the housing assembly 1 is referred to as an internal circulation channel. Under the exhaust function, a path along which the airflow flows through the housing assembly 1 is referred to as an exhaust channel. As described above, the air treatment assembly 4 is disposed in the exhaust cavity 103, which enables the air treatment assembly 4 to be located in the fresh air channel and the inner circulation channel, and thus the air can be first treated and then discharged into the indoor space. Therefore, the fresh air channel and the inner circulation channel may be defined as an air treatment channel. In addition, the air treatment assembly 4 may not be provided in the exhaust channel, which can prolong the service life of the air treatment assembly 4. In addition, with the air treatment device 1000 according to the embodiments of the present disclosure, by providing the first valve assembly 31 and the second valve assembly 32, the exhaust channel can be closed while the air treatment channel can be switched on, and the air treatment channel is closed while the exhaust channel is opened, to realize different functions.

With the air treatment device 1000 according to the embodiment of the present disclosure, an inner cavity of the housing assembly 1 is designed as above, and the first valve assembly 31 and the second valve assembly 32 having the above-mentioned functions are provided, it is possible to at least realize switching among the internal circulation function, the fresh air function, and the exhaust function to satisfy user's different demands. In addition, the first valve assembly 31 and the second valve assembly 32 are independent of each other, eliminating mutual constraints and influences between arrangement positions of these valve assemblies. As a result, it is possible to set an arrangement position of each valve assembly based on actual structural layout requirements. Therefore, flexibility in the design and adaptability to different models can be improved.

The present disclosure is not limited in this regard. In other examples of the present disclosure, the inlet of the ventilation cavity 101 may only be in direct or indirect communication with the indoor space, or the inlet of the ventilation cavity 101 may only be in direct or indirect communication with the outdoor space, and the description thereof in detail will be omitted herein.

In some embodiments of the present disclosure, as illustrated in FIG. 2, the fresh air component 100 may include a fan assembly 2. The fan assembly 2 may be disposed in the ventilation cavity 101. That is, the fan assembly 2 is at least partially disposed in the ventilation cavity 101. In addition, when the fan assembly 2 operates, the pressure at the outlet of the ventilation cavity 101 is smaller than the pressure at the inlet of the ventilation cavity 101. The present disclosure is not limited in this regard. In other embodiments of the present disclosure, the fan assembly 2 may not be disposed in the ventilation cavity 101. For example, the fan assembly 2 may be disposed in the fresh air cavity 102, the exhaust cavity 10, or the like. In addition, the specific type of the fan assembly 2 is not limited, and may be selected based on an airflow direction and an air supply requirement, and the present disclosure is not limited thereto. For example, the fan assembly 2 may include a centrifugal fan, a cross-flow fan, an axial flow fan, and the like.

In some embodiments of the present disclosure, as illustrated in FIG. 2, the inlet of the ventilation cavity 101 (the second inlet 101*b* illustrated in FIG. 2) is adapted to be in communication with the outdoor space through the fresh air cavity 102. Therefore, the inlet of the ventilation cavity 101 (the second inlet 101*b* illustrated in FIG. 2) is adapted to be in communication with the fresh air cavity 102 with a communicable characteristic of the fresh air cavity 102 with the outdoor space. As a result, it is possible to effectively ensure that the inlet of the ventilation cavity 101 is in indirect communication with the outdoor space, which in turn simplifies the structure. The present disclosure is not limited in this regard. The inlet of the ventilation cavity 101 may also be configured to be in communication with the outdoor space through other paths, rather than through the fresh air cavity 102. That is, the ventilation cavity 101 may be configured to be in communication with the outdoor space through other paths expect the fresh air cavity 102. For example, a hose may be provided to allow an end of the hose to be in direct communication with the outdoor space and the other end to be in direct communication with the ventilation cavity 101, and description thereof in detail will be omitted herein.

For example, in some examples of the present disclosure, as illustrated in FIG. 2, the air conditioning device 1000 may have a fresh air inlet 303 adapted to be in communication with the outdoor space to allow the air conditioning device 1000 to discharge the air into the outdoor space or introduce fresh air from the outdoor space through the fresh air inlet 303. In this case, the fresh air cavity 102 may be adapted to be in direct or indirect communication with the fresh air inlet 303. The inlet (the second inlet 101*b* as illustrated in FIG. 2) of the ventilation cavity 101 and the outlet (a second outlet 101*d* as illustrated in FIG. 2) of the ventilation cavity 101 are in indirect communication with the fresh air inlet 303 through the fresh air cavity 102, respectively.

In a case where the fresh air inlet 303 is in communication with the outdoor space and the fresh air cavity 102, as illustrated in FIG. 2, when the air pressure in the ventilation cavity 101 is smaller than the air pressure of the outdoor environment, the outdoor air may enter the fresh air cavity 102 through the fresh air inlet 303, and then enter the ventilation cavity 101 through the fresh air cavity 102. As illustrated in FIG. 4, when the air pressure in the ventilation cavity 101 is greater than the air pressure of the outdoor environment and the second valve assembly 32 is opened, the air in the ventilation cavity 101 can be discharged into the fresh air cavity 102, and the air in the fresh air cavity 102 can be discharged into the outdoor space through the fresh air inlet 303.

In some embodiments of the present disclosure, as illustrated in FIG. 2, the control valve assembly may further include a third valve assembly 33. When the third valve assembly 33 is in an open state, the inlet (the second inlet 101*b* as illustrated in FIG. 2) of the ventilation cavity 101 is in communication with the fresh air cavity 102. In some embodiments, the third valve assembly 33 is switchable between the open state and a close state. As illustrated in FIG. 2, when the third valve assembly 33 is in the open state, the air can be sucked into the ventilation cavity 101 from the fresh air cavity 102. In this case, when the air pressure in the ventilation cavity 101 is smaller than the air pressure in the fresh air cavity 102, the air in the fresh air cavity 102 flows into the ventilation cavity 101 through the inlet (the second inlet 101*b* as illustrated in FIG. 2) of the ventilation cavity 101.

As illustrated in FIG. 3, when the third valve assembly 33 is in the close state, the air cannot be sucked through the inlet (the second inlet 101*b* as illustrated in FIG. 3) of the ventilation cavity 101 from the fresh air cavity 102. In this case, when the air pressure in the ventilation cavity 101 is smaller than the air pressure in the fresh air cavity 102, the air in the fresh air cavity 102 cannot flow into the ventilation cavity 101. At this time, when the ventilation cavity 101 is in communication with the indoor space, the indoor air can flow into the ventilation cavity 101 through the inlet (the first inlet 101*a* as illustrated in FIG. 3) of the ventilation cavity 101.

Therefore, by switching the third valve assembly 33 into the open state, it is possible to supply the fresh air to the ventilation cavity 101 from the outdoor space while ensuring the fresh air function. In addition, by switching the third valve assembly 33 into the close state, the air is supplied to the ventilation cavity 101 only from the indoor space without any outdoor fresh air entering the ventilation cavity 101 while ensuring the internal circulation function and the exhaust function. Therefore, operation efficiency of the internal circulation and the exhaust can be improved to lower energy consumption.

Figure 5:
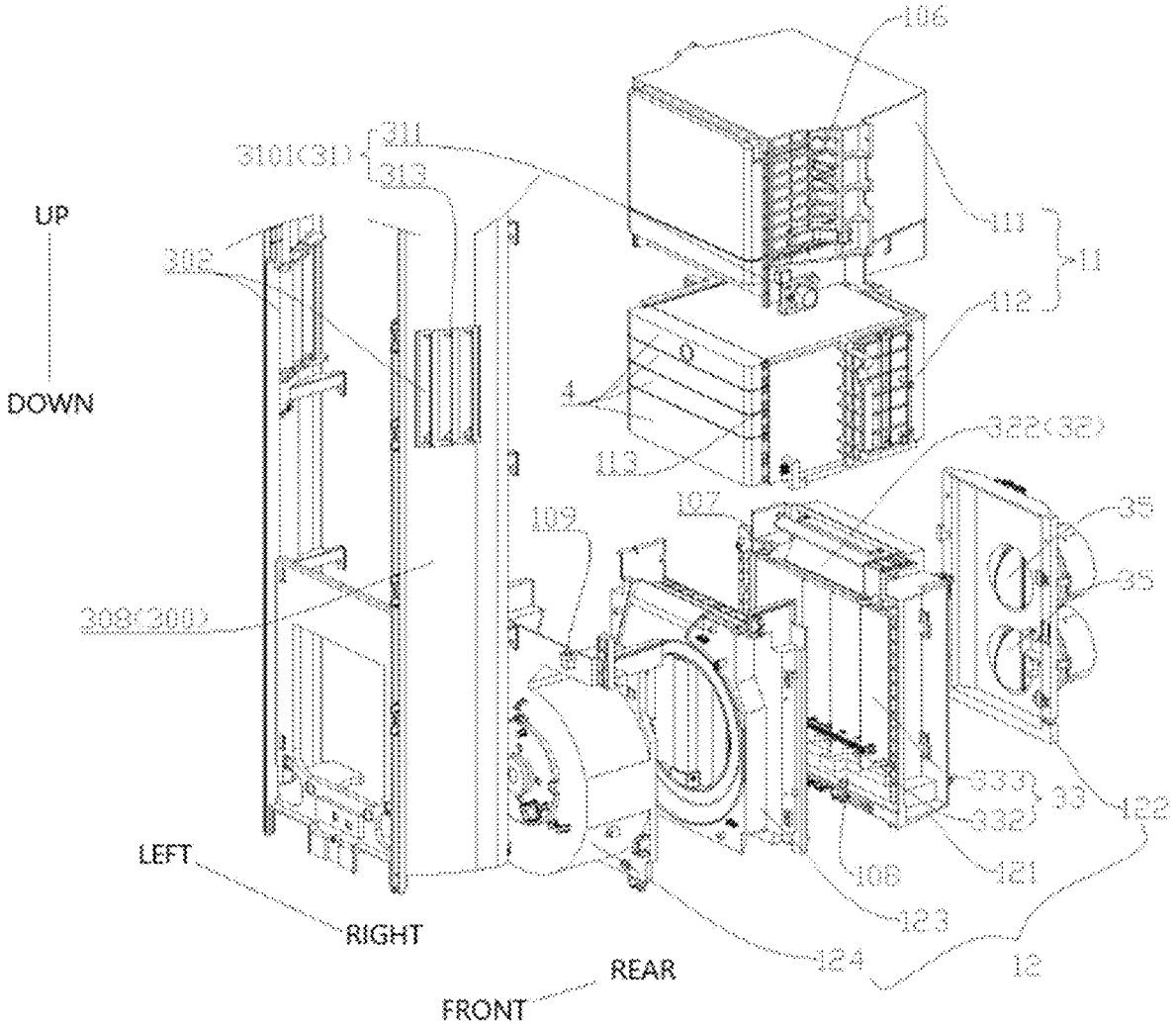
FIG. 5 is a partial exploded view of the air conditioning device illustrated in FIG. 1.

In some embodiments of the present disclosure, as illustrated in FIG. 4 and FIG. 5, the fresh air cavity 102 is located at a rear side of the ventilation cavity 101. The third valve assembly 33 is disposed between a front of the fresh air cavity 102 and a rear of the ventilation cavity 101. That is, the ventilation cavity 101 has the second inlet 101*b*. In addition, when the second inlet 101*b* is in communication with the outlet of the fresh air cavity 102, the third valve assembly 33 may be disposed at the second inlet 101*b*. The third valve assembly 33 may include a plurality of first vertical baffles 333 sequentially arranged in a left-right direction. Each of the plurality of first vertical baffles 333 is pivotally connected to the housing assembly 1. For example, a pivot axis of each of the plurality of first vertical baffles 333 vertically extends. Therefore, the third valve assembly 33 has a simple structure and can be controlled easily. Further, the third valve assembly 33 has a small space occupation and good switching between the open state and the close state.

For example, when the third valve assembly 33 is in the close state, the plurality of first vertical baffles 333 is substantially located on the same plane, and two adjacent first vertical baffles 333 abut or overlap with each other, or a slight small airflow gap is formed between the two adjacent first vertical baffles 333. When the third valve assembly 33 is in the open state, the plurality of first vertical baffles 333 is arranged in parallel to each other, which can ensure a greater spacing between two adjacent first vertical baffles 333 and enhance a flow rate at which the airflow flows between the two adjacent first vertical baffles 333. In addition, it is possible to reduce wind resistance and the energy consumption.

In addition, in combination with FIG. 5, the third valve assembly 33 may further include a third driver and a third connection rod 332. The third connection rod 332 extends in the left-right direction. Each of the plurality of first vertical baffles 333 has an upper end or a lower end connected to the third connection rod 332. The third driver can drive one of the plurality of first vertical baffles 333 to rotate, and the one of the plurality of first vertical baffles 333 can drive the rest of third baffles to rotate by the third connection rod 332. Therefore, the third valve assembly 33 is simple in structure. In addition, it is convenient to control the third valve assembly 33 to be switchable between the open state and the close state.

In some embodiments of the present disclosure, as illustrated in FIG. 4 and FIG. 5, the first valve assembly 31 may include a downstream control valve 3101. The downstream control valve 3101 is disposed downstream of the air treatment assembly 4. That is, in an airflow flowing direction, the downstream control valve 3101 is located downstream of the air treatment assembly 4. In this way, when the downstream control valve 3101 is in a close state, even if airflow discharged from the ventilation cavity 101 enters the exhaust cavity 103 and is treated by the air treatment assembly 4, the airflow will be intercepted by the downstream control valve 3101 and cannot flow towards the air outlet 302. Therefore, it is possible to prevent the airflow in the ventilation cavity 101 from being discharged to the indoor space from the air outlet 302 through the exhaust cavity 103.

Therefore, by arranging the downstream control valve 3101 downstream of the air treatment assembly 4, it is possible to ensure that the downstream control valve 3101 can be provided with a great space while ensuring that the downstream control valve 3101 satisfies the above functional requirements. Therefore, downstream control valves 3101 in various forms or several downstream control valves 3101 may be selected to better achieve the function of the first valve assembly 31. In addition, it is advantageous for early-stage installation and later maintenance of the downstream control valve 3101.

In some embodiments of the present disclosure, as illustrated in FIG. 4 and FIG. 5, the downstream control valve 3101 is disposed at the air outlet 302 and configured to controlling opening or closing of the air outlet 302. Therefore, the installation of the downstream control valve 3101 is more convenient. For example, in an example of the present disclosure, the air conditioning device 1000 may further include a casing component 300. The housing assembly 1 is located in the casing component 300. The air outlet 302 is formed on the casing component 300. The downstream control valve 3101 is mounted on the casing component 300 and configured to control the opening or the closing of the air outlet 302. Therefore, installation is facilitated. The present disclosure is not limited in this regard. In other embodiments of the present disclosure, the housing assembly 1 may also directly serve as an appearance surface of the air conditioning device 1000. In this case, the housing assembly 1 is not provided in the casing component 300, and the air outlet 302 may be formed on the housing assembly 1.

In addition, in other embodiments of the present disclosure, the downstream control valve 3101 may also not be disposed at the air outlet 302. For example, in other embodiments, the downstream control valve 3101 may be disposed upstream of the air outlet 302. That is, in the airflow flowing direction, the downstream control valve 3101 is located between the air treatment assembly 4 and the air outlet 302. When the downstream control valve 3101 is in the close state, even if the airflow discharged from the ventilation cavity 101 enters the exhaust cavity 103 and is treated by the air treatment assembly 4, the airflow will be intercepted by the downstream control valve 3101 and cannot flow towards the air outlet 302. Therefore, it is possible to prevent the airflow in the ventilation cavity 101 from being discharged to the indoor space from the air outlet 302 through the exhaust cavity 103.

For example, when the housing assembly 1 is located in the casing component 300 and the air outlet 302 is formed on the casing component 300, an indoor air outlet 106 in communication with the air outlet 302 may be formed on the housing assembly 1. Further, the downstream control valve 3101 may be disposed at the indoor air outlet 106 to be located between the air treatment assembly 4 and the air outlet 302. In addition, it should be noted that, when the downstream control valve 3101 is located between the air treatment assembly 4 and the air outlet 302, the first valve assembly 31 may further include a valve disposed at the air outlet 302. In an example, no valve may be disposed at the air outlet 302 to allow the air outlet 302 to be in the open state. In an example, a ventilation grille may be provided at the air outlet 302.

In some embodiments of the present disclosure, as illustrated in FIG. 4 and FIG. 5, the downstream control valve 3101 may include a plurality of second vertical baffles 313 sequentially arranged in a transverse direction of the air outlet 302. For example, a pivot axis of each of the plurality of second vertical baffles 313 vertically extends. Therefore, the downstream control valve 3101 has a simple structure, and can be controlled easily. Further, the downstream control valve 3101 has a small space occupation and good switching between the open state and the close state.

For example, when the downstream control valve 3101 is in the close state, the plurality of second vertical baffles 313 is substantially located on the same plane, and two adjacent second vertical baffles 313 abut or overlap with each other, or a slight small airflow gap is formed between the two adjacent second vertical baffles 313. When the downstream control valve 3101 is in the open state, the plurality of second vertical baffles 313 is arranged in parallel to each other, which can ensure a greater spacing between two adjacent second vertical baffles 313 and enhance a flow rate at which the airflow flows between the two adjacent second vertical baffles 313. In addition, it is possible to reduce wind resistance and energy consumption.

In addition, in combination with FIG. 5, the downstream control valve 3101 may further include a first driver 311 and a first connection rod. The first connection rod extends in the transverse direction of the air outlet 302. Each of the plurality of second vertical baffles 333 has an upper end or a lower end connected to the first connection rod. The first driver can drive one of the plurality of second vertical baffles 313 to rotate, and the one of the plurality of second vertical baffles 313 can drive the rest of second vertical baffles 313 to rotate by the first connection rod. Therefore, the downstream control valve 3101 is simple in structure. In addition, it is convenient to control the downstream control valve 3101 to be switchable between the open state and the close state.

Figure 6:
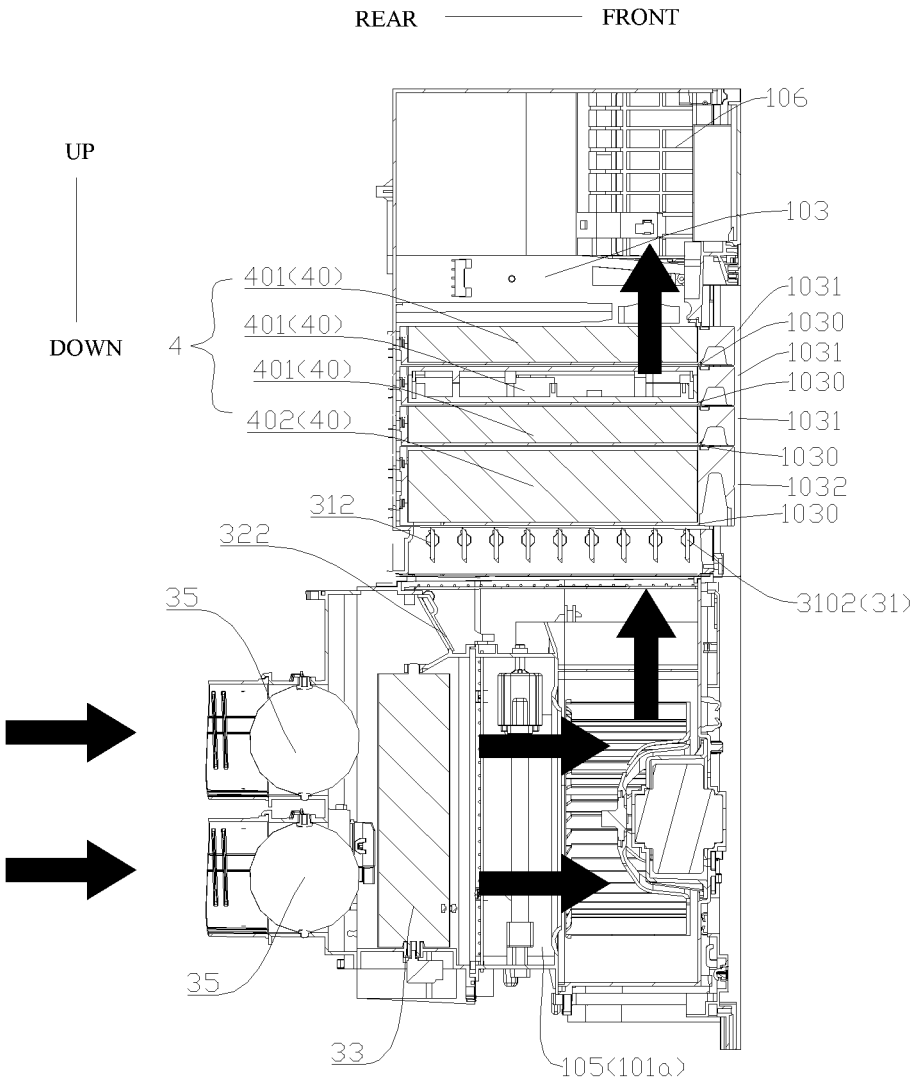
FIG. 6 is a cross-sectional view of a fresh air component under a fresh air function according to another embodiment of the present disclosure.

In some embodiments of the present disclosure, as illustrated in FIG. 6, the first valve assembly 31 may further include an upstream control valve 3102. The upstream control valve 3102 is disposed upstream of the air treatment assembly 4. That is, in the airflow flow direction, the upstream control valve 3102 may be located upstream of the air treatment assembly 4. In this way, when the upstream control valve 3102 is in the close state, even if the airflow discharged from the ventilation cavity 101 enters the exhaust cavity 103, the airflow will not be treated by the air treatment assembly 4. Therefore, it is possible to reduce a utilization rate of the air treatment assembly 4 and prolong the service life of the air treatment assembly 4.

In addition, it should be noted that, in other embodiments of the present disclosure, the first valve assembly 31 may also include an upstream control valve 3102 arranged upstream of the air treatment assembly 4 and a downstream control valve 3101 arranged at the air outlet 302. In this way, on the one hand, the utilization rate of the air treatment assembly 4 can be lowered by using the upstream control valve 3102, and on the other hand, tightness of the air outlet 302 can be improved by using the downstream control valve 3101.

In some embodiments of the present disclosure, as illustrated in FIG. 6, the upstream control valve 3102 is located below the air treatment assembly 4. The upstream control valve 3102 may include a plurality of first transverse baffles 312 sequentially arranged in a front-rear direction. Each of the plurality of first transverse baffles 312 is pivotally connected to the housing assembly 1. For example, a pivot axis of each of the plurality of first transverse baffles 312 extends in the left-right direction. Therefore, the upstream control valve 3102 has a simple structure, and can be controlled easily. Further, the upstream control valve 3102 has a small space occupation and good switching between the open state and the close state.

For example, when the upstream control valve 3102 is in the close state, the plurality of first transverse baffles 312 is substantially located on the same plane, and two adjacent first transverse baffles 312 abut or overlap with each other, or a slight small airflow gap is formed between the two adjacent first transverse baffles 312. When the upstream control valve 3102 is in the open state, the plurality of upstream control valves 3102 is arranged in parallel to each other, which can ensure a greater spacing between two adjacent upstream control valves 3102 and enhance a flow rate at which the airflow flows between the two adjacent upstream control valves 3102. In addition, it is possible to reduce wind resistance and the energy consumption. In addition, the upstream control valve 3102 may further include a sixth driver and a sixth connection rod. The sixth connection rod extends in the front-back direction. Each of the plurality of first transverse baffles 312 has a left end or a right end connected to the sixth connection rod. The sixth driver can drive one of the plurality of first transverse baffles 312 to rotate, and the one of the plurality of first transverse baffles 312 can drive the rest of the plurality of first transverse baffles 312 to rotate by the sixth connection rod. Therefore, the upstream control valve 3102 is simple in structure. In addition, it is convenient to control the upstream control valve 3102 to be switchable between the open state and the close state.

In some embodiments of the present disclosure, as illustrated in FIG. 4 and FIG. 5, the fresh air cavity 102 may be provided at the rear side of the ventilation cavity 101. The exhaust cavity 103 may be provided above the ventilation cavity 101. The ventilation cavity 101 includes an upper cavity 1013. A top of the upper cavity 1013 is in communication with the exhaust cavity 103 through a first outlet 101*c*. A rear of the upper cavity 1013 is in communication with an upper part of the fresh air cavity 102 through a second outlet 101*d*. The second valve assembly 32 is disposed at the second outlet 101*d* and configured to control opening or closing of the second outlet 101*d*. Therefore, it is possible to better shorten an air inlet path between the ventilation cavity 101 and the fresh air cavity 102 and an exhaust path between the ventilation cavity 101 and the fresh air cavity 102. Further, an exhaust path from the ventilation cavity 101 to the exhaust cavity 103 can also be shortened. As a result, the energy consumption can be lowered. Therefore, the housing assembly 1 has a small and compact structure.

As illustrated in FIG. 4 and FIG. 5, when the second valve assembly 32 is disposed at the second outlet 101*d*, and the third valve assembly 33 is disposed at the second inlet 101*b* between the front of the fresh air cavity 102 and the rear of the ventilation cavity 101, the second valve assembly 32 may be located above the third valve assembly 33. Therefore, it is possible to ensure that the third valve assembly 33 and the second valve assembly 32 each have a larger mounting space. As a result, mutual interference and influence between the third valve assembly 33 and the second valve assembly 32 can be avoided.

In some embodiments of the present disclosure, as illustrated in FIG. 4 and FIG. 5, the second valve assembly 32 includes a second transverse baffle 322 pivotally connected to the housing assembly 1. For example, an upper end of the second transverse baffle 322 is pivotally connected to the housing assembly 1. For example, a pivot axis of the second transverse baffle 322 extends in the left-right direction. Therefore, the second valve assembly 32 is simple in structure, and can be controlled easily. Further, the second valve assembly 32 has a small space occupation and good switching between the open state and the close state. In addition, in combination with FIG. 7, the second valve assembly 32 may further include a second driver 321. The second driver 321 is directly connected to the second transverse baffle 322 to drive the second transverse baffle 322 to rotate. Therefore, the second valve assembly 32 has a simple structure, and can be controlled easily to be switchable between an open state and a close state.

In some embodiments of the present disclosure, as illustrated in FIG. 4 and FIG. 5, a centrifugal fan 21 is disposed in the ventilation cavity 101. Therefore, arrangement of the ventilation cavity 101, the fresh air cavity 102, and the exhaust cavity 103 is suitable for operation characteristics of the centrifugal fan 21, enabling the centrifugal fan 21 to supply air at a rear side of the centrifugal fan 21 and discharge the air at an upper side of the centrifugal fan 21. Therefore, with the centrifugal fan 21, it is possible to improve a ventilation volume, satisfy requirements of great fresh air volume, and the like. It should be noted that, orientation terms such as upper, lower, left, right, front, rear, or the like are intended to simplify and clearly describing the present disclosure and do not be understood to limit the present disclosure based on the description of the drawings. For example, when the air treatment device 1000 is applied in a vertical air conditioner, a side of the vertical air conditioner facing towards the user is referred to as a front side, and a side facing away from the user is referred to as a rear side. An up-down direction of the vertical air conditioner is referred to as a vertical direction, and a direction perpendicular to the vertical direction is referred to as a transverse direction.

For example, in an example illustrated in FIG. 4 and FIG. 5, the ventilation cavity 101 may include a front cavity 1011, a rear cavity 1012, and an upper cavity 1013. The rear cavity 1012 is located in front of the fresh air cavity 102. The front cavity 1011 is located in front of the rear cavity 1012. The centrifugal fan 21 is located at the front cavity 1011. The upper cavity 1013 is located above the front cavity 1011 and the rear cavity 1012. The upper cavity 1013 is in communication with a top of the front cavity 1011. The first outlet 101*c* is formed at a top of the upper cavity 1013, and the second outlet 101*d* is formed at a rear of the upper cavity 1013.

In addition, the fresh air component 100 may further include a drive motor 22. The drive motor 22 is connected to the centrifugal fan 21 to obtain the fan assembly 2 composed of the centrifugal fan 21 and the drive motor 22. The drive motor 22 is mounted in the housing assembly 1. The centrifugal fan 21 is located in the front cavity 1011. Therefore, the front cavity 1011 may be used as a volute casing of the fan assembly 2.

In some embodiments of the present disclosure, as illustrated in FIG. 1 and FIG. 3, the air conditioning device 1000 further has a return air inlet 301. The return air inlet 301 is adapted to be in communication with the indoor space to enable the air conditioning device 1000 to introduce the indoor air through the return air inlet 301. The control valve assembly further includes a fourth valve assembly 34. The inlet (the first inlet 101*a* as illustrated in FIG. 3) of the ventilation cavity 101 is in communication with the indoor space through the return air inlet 301 when the fourth valve assembly 34 is in an open state. At this time, when the air pressure in the ventilation cavity 101 is smaller than the air pressure of the indoor environment, the indoor air may enter the ventilation cavity 101 through the return air inlet 301.

In some embodiments, the fourth valve assembly 34 is switchable between an open state and a close state. As illustrated in FIG. 3 and FIG. 4, when the fourth valve assembly 34 is in the open state, the ventilation cavity 101 is in communication with the return air inlet 301, and the return air inlet 301 is in communication with the indoor space, the air can be sucked to the ventilation cavity 101 from the indoor space through the return air inlet 301. In this case, when the air pressure in the ventilation cavity 101 is smaller than the air pressure of the indoor environment, the indoor air flows into the ventilation cavity 101 through the return air inlet 301.

As illustrated in FIG. 2, when the fourth valve assembly 34 is in the close state, the ventilation cavity 101 is not in communication with the return air inlet 301, and/or the return air inlet 301 is not in communication with the indoor space, the air cannot be sucked to the ventilation cavity 101 from the indoor space through the return air inlet 301. In this case, when the air pressure in the ventilation cavity 101 is smaller than the air pressure of the indoor environment, the indoor air cannot flow to the return air inlet 301, or the air flowing to the return air inlet 301 cannot flow into the ventilation cavity 101, or the indoor air cannot flow to the return air inlet 301 and the air flowing to the return air inlet 301 cannot flow into the ventilation cavity 101.

In this way, as illustrated in FIG. 2, the fourth valve assembly 34 may be switched into the close state under the fresh air function. In this case, only outdoor air is supplied to the ventilation cavity 101. Therefore, a sufficient inlet volume of fresh air can be ensured. As illustrated in FIG. 3 and FIG. 4, the fourth valve assembly 34 is switched into the open state under the internal circulation function and the exhaust function. Therefore, the requirement for supplying the air to the ventilation cavity 101 from the indoor space can be satisfied.

It should be noted that arrangement positions of the return air inlet 301 and an arrangement position of the fourth valve assembly 34 are not limited, as long as the above requirements are satisfied. For example, as described above, when the air conditioning device 1000 includes the casing component 300 and the housing assembly 1 is located in the casing component 300, the return air inlet 301 may be formed on the casing component 300. In this case, the housing assembly 1 may have an indoor return air inlet 105 in communication with the return air inlet 301. In an example, the first inlet 101*a* and the indoor return air inlet 105 may be the same opening, which can further shorten an air inlet path from the return air inlet 301 to the ventilation cavity 101, and enable the structure of the housing assembly 1 to be small and compact. When the housing assembly 1 is used as the appearance surface of the air conditioning device 1000, the return air inlet 301 may be formed on the housing assembly 1.

For example, in some embodiments, the fourth valve assembly 34 may be disposed at the return air inlet 301 and configured to control the opening or the closing of the return air inlet 301. As a result, a greater installation space can be provided to facilitate control. In addition, the fourth valve assembly 34 may be in the form of an electrical openable/closable door, an electrical air deflector, a manual openable/closable door, or the like, and the present disclosure is not limited thereto. The fourth valve assembly 34 may also be disposed on an airflow channel between the return air inlet 301 and the inlet of the ventilation cavity 101. For example, when the housing assembly 1 is located in the casing component 300 and the return air inlet 301 is formed on the casing component 300, the housing assembly 1 has the indoor return air inlet 105. The indoor return air inlet 105 serves as the inlet of the ventilation cavity 101 and is in communication with the return air inlet 301 on the casing component 300. In this case, the fourth valve assembly 34 may be disposed at the indoor return air inlet 105 on the housing assembly 1, and the description thereof in detail will be omitted herein.

The present disclosure is not limited in this regard. In other embodiments of the present disclosure, the control valve assembly may have no fourth valve assembly 34. In this case, the ventilation cavity 101 may be in constant communication with the return air inlet 301, and the return air inlet 301 is also in constant communication with the indoor space. As long as the air pressure in the ventilation cavity 101 is smaller than the air pressure of the indoor environment, the indoor air flows into the ventilation cavity 101 through the return air inlet 301. For example, under the fresh air function, the internal circulation function, and the exhaust function, the indoor air may enter the ventilation cavity 101. For example, under the fresh air function, the indoor air and outdoor fresh air enter the ventilation cavity 101 simultaneously, and are discharged into the indoor space after treated by the air treatment assembly 4. Therefore, a predetermined internal circulation effect can be provided while realizing the fresh air function. In addition, when the control valve assembly has no fourth valve assembly 34, a ventilation grille may be provided at the return air inlet 301 to achieve a safe effect.

In some embodiments of the present disclosure, as illustrated in FIG. 2, the fresh air component 100 may further include a fresh air pipe 5. The control valve assembly may include a fifth valve assembly 35. The fresh air pipe 5 has an end defining a fresh air inlet 303 and the other end in communication with the fresh air cavity 102. The fifth valve assembly 35 is disposed at the fresh air pipe 5. The fresh air cavity 102 is in communication with the outdoor pace through the fresh air pipe 5 when the fifth valve assembly 35 is in an open state. Therefore, by providing the fifth valve assembly 35, overall tightness of the air treatment device 1000 can be improved without sucking the air or discharging the air by using the fresh air pipe 5.

In some embodiments, the fifth valve assembly 35 is switchable between an on state and a close state. As illustrated in FIG. 2, when the fifth valve assembly 35 is in the open state, the outdoor air can be introduced into the fresh air cavity 102 from the outdoor space through the fresh air pipe 5. In this case, when the air pressure in the fresh air cavity 102 is lower than outdoor air pressure, the outdoor air flows into the fresh air pipe 5 and then enters the fresh air cavity 102. As illustrated in FIG. 3, when the fifth valve assembly 35 is in the close state, the outdoor cannot be introduced into the fresh air cavity 102 from the outdoor space through the fresh air pipe 5. In this case, when the air pressure in the fresh air cavity 102 is lower than the outdoor air pressure, the outdoor air cannot flow into the fresh air pipe 5. Or, although the outdoor air can flow into the fresh air pipe 5, the air in the fresh air pipe 5 cannot enter the fresh air cavity 102; or, the outdoor air cannot flow into the fresh air pipe 5 and the air in the fresh air pipe 5 cannot enter the fresh air cavity 102. As illustrated in FIG. 4, in a case where the fifth valve assembly 35 is in the open state, when the air pressure in the fresh air cavity 102 is greater than the outdoor air pressure, the air in the fresh air cavity 102 will be discharged to the outdoor space through the fresh air pipe 5.

It should be noted that the fresh air pipe 5 may be connected to the outdoor space through a fresh air hose. Therefore, it is possible to enhance convenience and reliability of communication between the fresh air pipe 5 and the outdoor space. In addition, it should be noted that the number of fresh air pipes 5 is not limited, and one or more fresh air pipes 5 may be provided. When a plurality of fresh air pipes 5 is provided, the plurality of fresh air pipes 5 may be used simultaneously, or only one of the plurality of fresh air pipes 5 may be used, and others may be left for standby. It should be noted that a specific structure of the fifth valve assembly 35 is not limited. For example, the fifth valve assembly 35 may include a fifth driver and a fifth baffle. The fifth driver can drive the fifth baffle to rotate. Therefore, the fifth valve assembly 35 is simple in structure. In addition, it is convenient to control the fifth valve assembly 35 to be switchable between the open state and the close state.

As described above, the return air inlet 301 may serve as an air inlet of the internal circulation function and an air inlet of the exhaust function. The fresh air inlet 303 may serve as an air inlet of the fresh air function and an air outlet of the exhaust function. The air outlet 302 may serve as an air outlet of the fresh air function and an air outlet of the internal circulation function.

In addition, when the air conditioning device 1000 further includes the casing component 300, and the housing assembly 1 is located in the casing component 300, both the return air inlet 301 and the air outlet 302 may be formed on the casing component 300. As illustrated in FIGS. 2 to 4, the fresh air inlet 303 is formed on the fresh air pipe 5. An outdoor fresh air inlet 104, an indoor return air inlet 105, and an indoor air outlet 106 are formed on the housing assembly 1. The outdoor fresh air inlet 104 is in communication with the fresh air cavity 102. The indoor return air inlet 105 is in communication with the ventilation cavity 101. The indoor air outlet 106 is in communication with the exhaust cavity 103. The outdoor fresh air inlet 104 is in communication with the fresh air inlet 303 through the fresh air pipe 5. The indoor return air inlet 105 is in communication with the return air inlet 301. The indoor air outlet 106 is in communication with the air outlet 302. When the housing assembly 1 is not disposed in the casing component 300, the housing assembly 1 may serve as the appearance surface of the air conditioning device 1000. In this case, the return air inlet 301 and the air outlet 302 may each be formed on the housing assembly 1.

Figure 7:
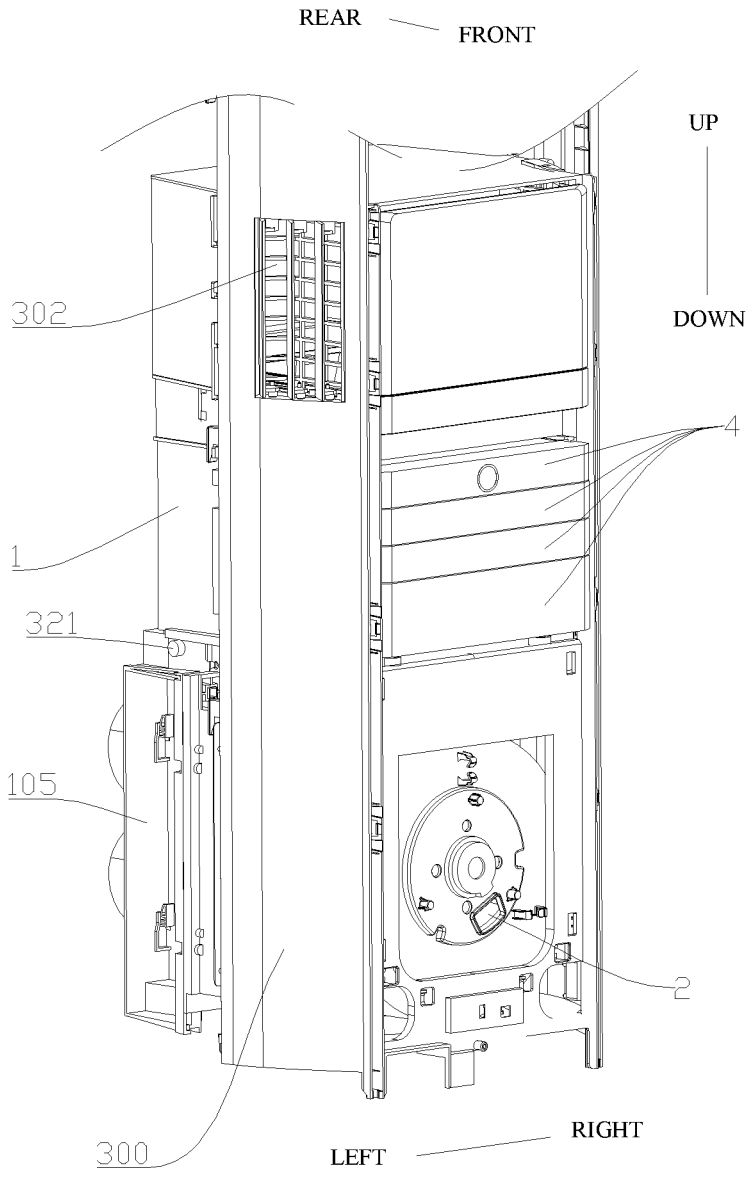
FIG. 7 is a partial assemble view of the air conditioning device illustrated in FIG. 5.
Figure 8:
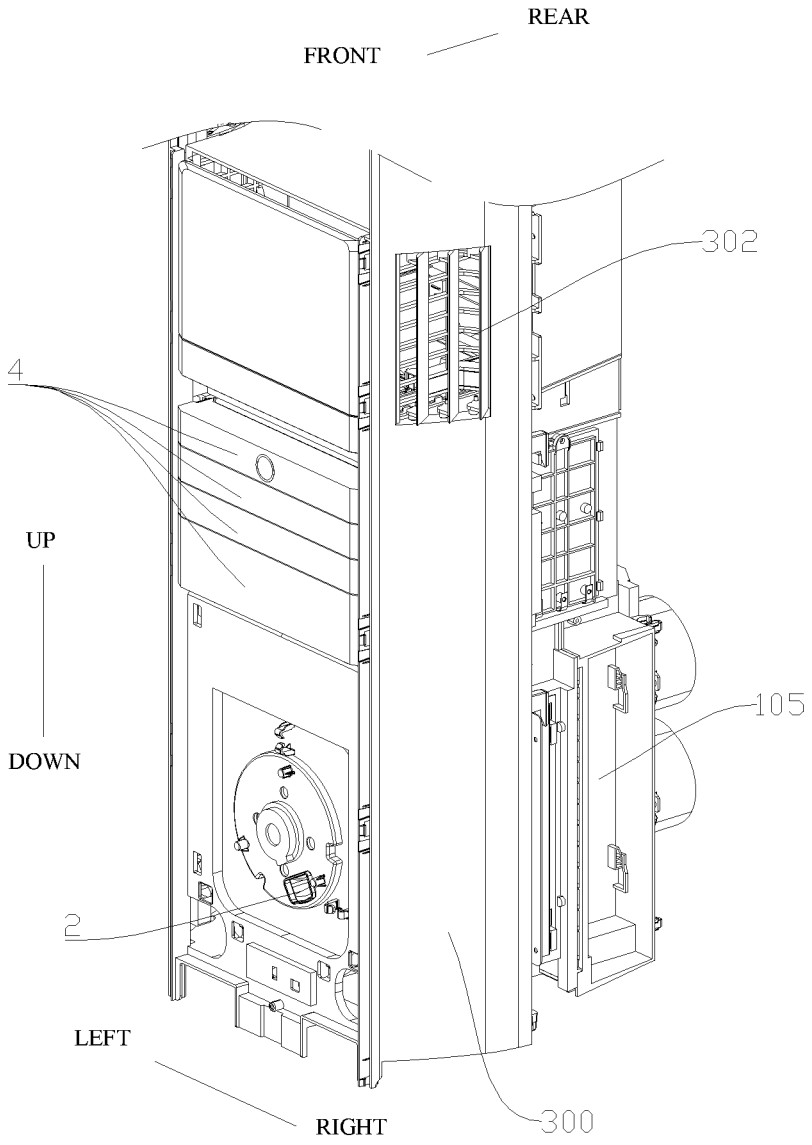
FIG. 8 is an assemble view shown in FIG. 7 in another direction.
Figure 9:
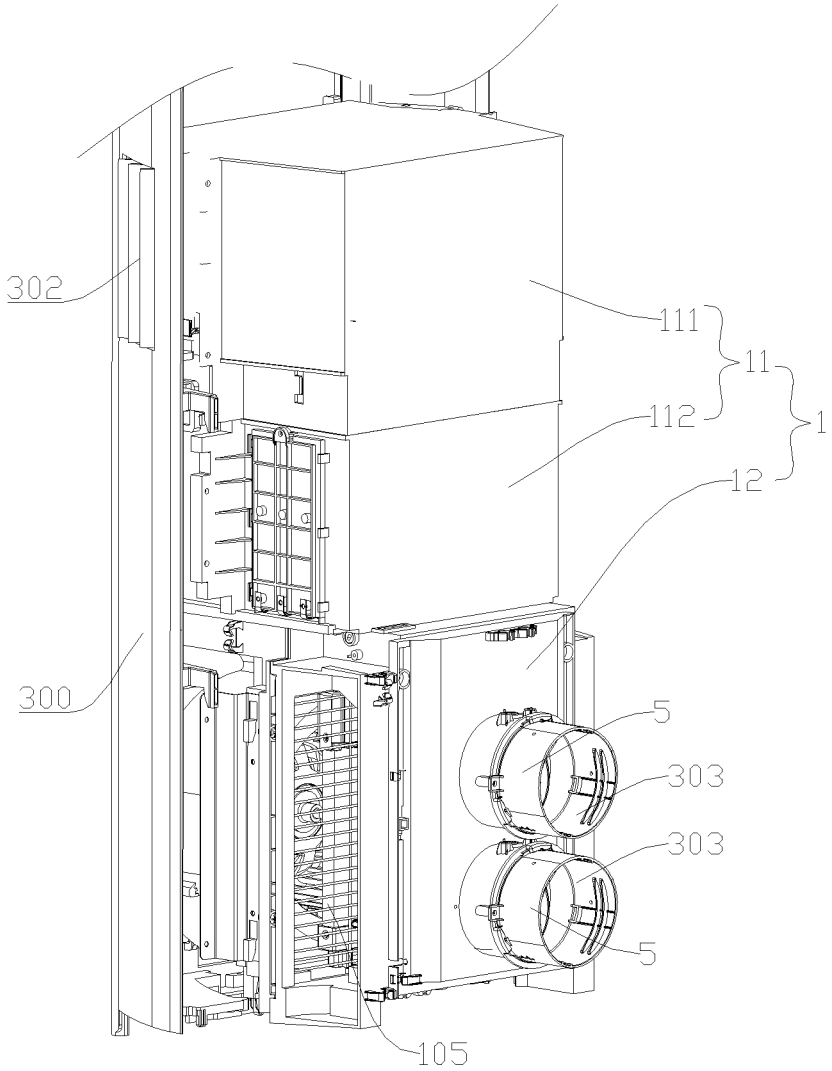
FIG. 9 is an assemble view shown in FIG. 7 in yet another direction.
Figure 10:
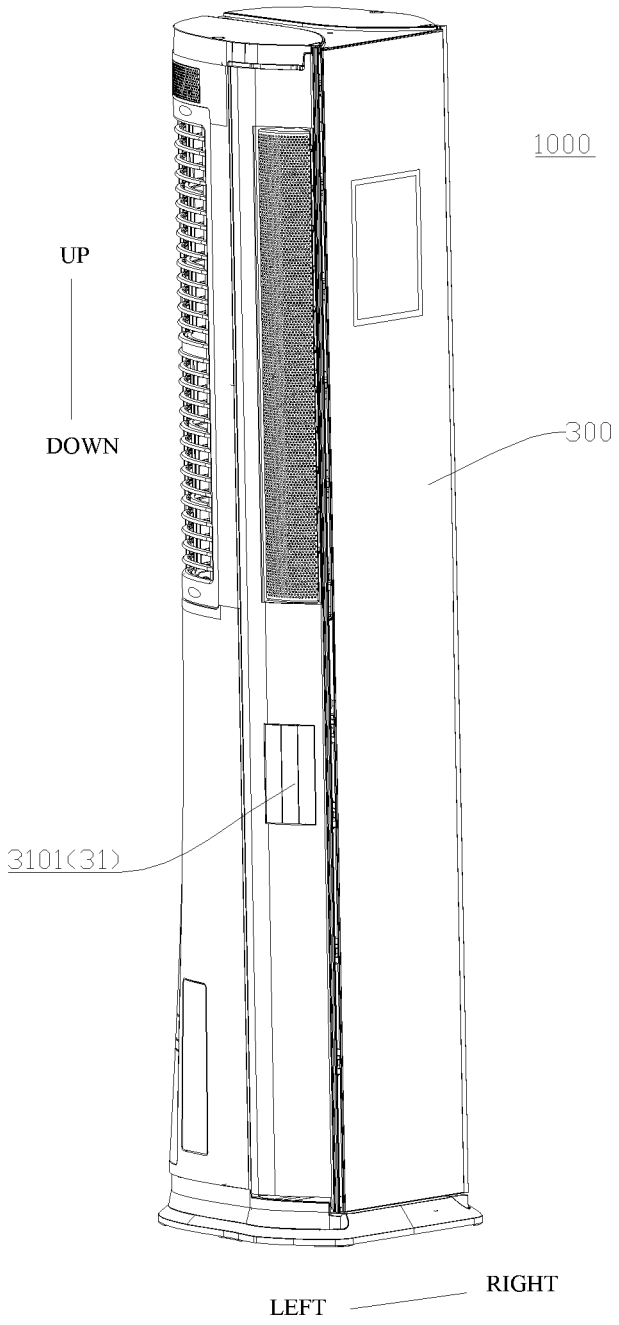
FIG. 10 is a perspective view of the air conditioning device illustrated in FIG. 1 in a direction.
Figure 11:
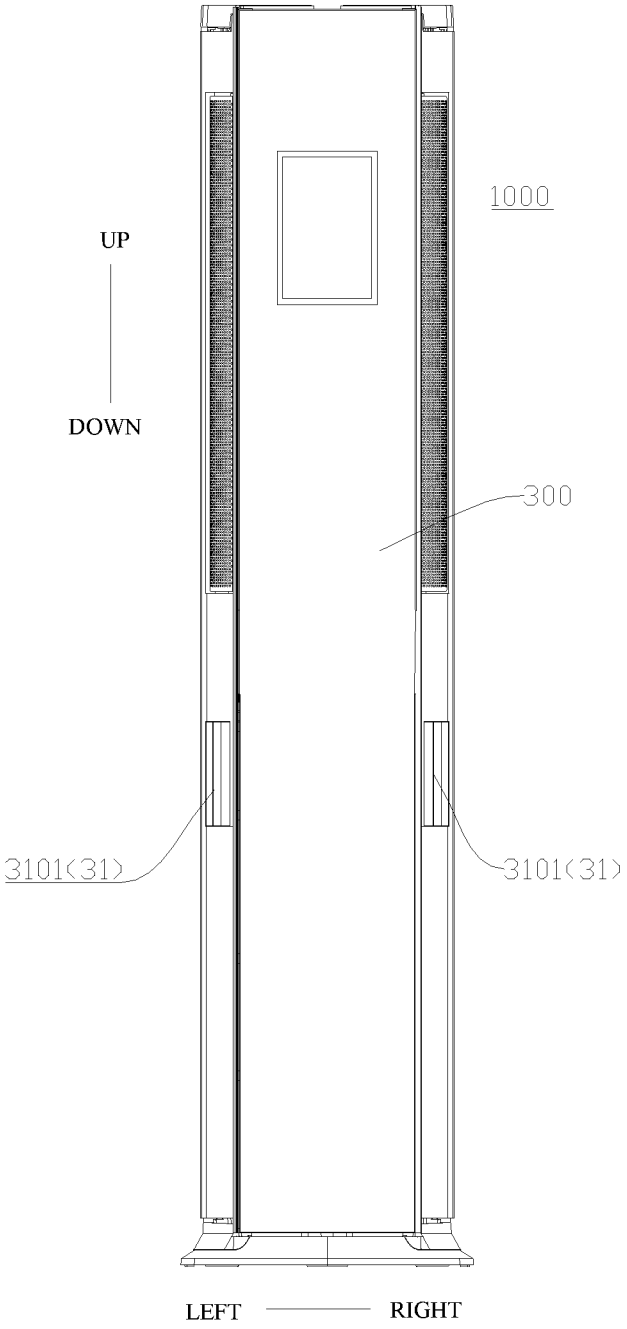
FIG. 11 is a front view of the air conditioning device illustrated in FIG. 10.
Figure 12:
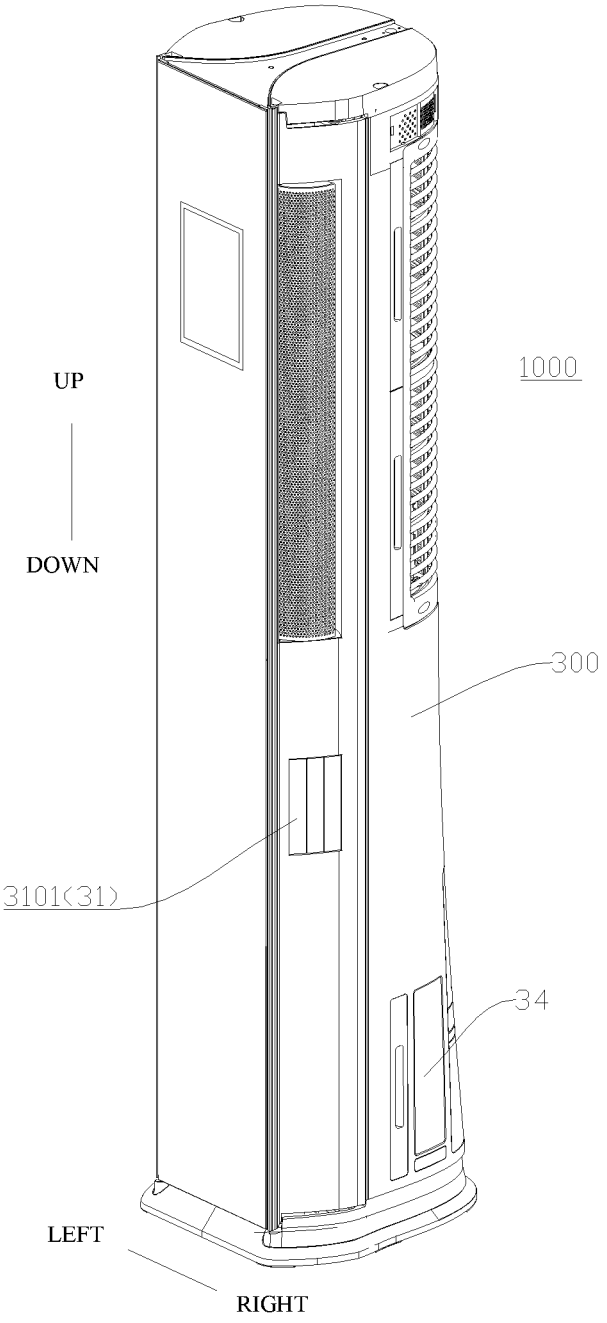
FIG. 12 is a perspective view of the air conditioning device illustrated in FIG. 10 in another direction.

In some embodiments of the present disclosure, as illustrated in FIG. 2 to FIG. 4, the outdoor fresh air inlet 104 may be formed at a rear side of a lower part of the housing assembly 1. As illustrated in FIG. 7 to FIG. 9, the indoor return air inlet 105 may be formed at each of a left side and a right side of the lower part of the housing assembly 1, and the indoor air outlet 106 may be formed at a front side and/or each of a left side and a right side of an upper part of the housing assembly 1. Therefore, it is possible to ensure that indoor exhaust air is far away from the indoor return air, and a return air problem can be avoided. In addition, it is possible to increase an exhaust air area as much as possible and ensure exhaust air requirements. In addition, it is possible to increase an inlet air area as much as possible and ensure the inlet air requirements. The present disclosure is not limited in this regard. The number of and an arrangement position of each of the outdoor fresh air inlet 104, the indoor return air inlet 105, and the indoor air outlet 106 may also be adjusted as desired, so long as ventilation requirements as described above can be satisfied, and details thereof will be omitted herein.

In some embodiments of the present disclosure, as illustrated in FIG. 5 and FIG. 6, the air treatment assembly 4 may be detachably mounted. For example, an accessible opening 113 is formed on a surface of the housing assembly. The air treatment assembly 4 includes a treatment module 40. One or more treatment modules 40 may be provided. At least one treatment module 40 is adapted to be inserted into the exhaust cavity 103 via the accessible opening 113. That is, the accessible opening 113 is configured for the insertion of the treatment module 40. The at least one treatment module 40 may be inserted into the exhaust cavity 103 via the accessible opening 113 and detached and removed from the exhaust cavity 103 by the accessible opening 113, to facilitate disassembly and assembly of the air treatment assembly 4. In addition, it is convenient for cleaning, replacement, or maintenance of the air treatment assembly 4. It should be noted that a specific type of each of the at least one treatment module 40 is not limited in this regard. For example, the treatment module 40 may be a humidification module, a filtration mesh module, a formaldehyde removal module, a volatile organic compound (VOC) removal module, a dust removal module, an allergen removal module, a disinfection and sterilization module, or a peculiar smell removal module.

In some embodiments of the present disclosure, as illustrated in FIG. 5 and FIG. 6, the air treatment assembly 4 includes a plurality of treatment modules 40. At least one of the plurality of treatment modules 40 is a first module 401, and at least one of the plurality of treatment modules 40 is a second module 402. That is, the air treatment assembly 4 includes at least one first module 401 and at least one second module 402. A plurality of mounting portions 1030 is provided on an inner wall of the exhaust cavity 103 and is arranged at intervals. A first mounting space 1031 is defined between two adjacent mounting portions 1030 and is configured for mounting of the first module 401. A plurality of first mounting spaces 1031 is provided and laminated to each other. The at least two adjacent first mounting spaces 1031 are configured to define a second mounting space 1032 for mounting of the second module 402.

Therefore, interchangeability of different first modules 401, interchangeability of different second modules 402, and interchangeability of the first module 401 and the second module 402 can be realized. That is, the user may replace the treatment module 40 based on different needs. For example, first modules 401 of different types may be mounted at any first mounting space 1031, and second modules 402 of different types may be mounted at the second mounting spaces 1032, or a corresponding number of the first modules 401 may be mounted at the second mounting spaces 1032. Therefore, actual usage requirements of the user may be better satisfied. It should be noted that specific configuration of the mounting portion 1030 is not limited. For example, the mounting portion 1030 may be constructed as a support shaft, a support plate, a support rail, or the like, and details thereof will be omitted herein.

In addition, in order to improve mounting stability and size stability of the treatment module 40, the treatment device 40 may be constructed into an inclined insertion structure. For example, when the accessible opening 113 is formed on a front surface of the housing assembly 1, the treatment module 40 may be configured to be inserted from top to bottom in a front-back direction. Such a configuration can not only increase the size of the treatment module 40 within the exhaust cavity 103 to improve air treatment effectiveness, but also enhance the mounting stability of the treatment module 40 to prevent the treatment module 40 from being automatically separated through the accessible opening 113 from rear to front. The present disclosure is not limited in this regard. The treatment module 40 may also be configured to be horizontally inserted, which can reduce the size of the treatment device 40 in an up-down direction, and improve structural compactness of the treatment module 40.

In some embodiments of the present disclosure, as illustrated in FIG. 4 and FIG. 5, the housing assembly 1 may include an upper housing assembly 11 and a lower housing assembly 12. The upper housing assembly 11 is provided above the lower housing assembly 12 and defines the exhaust cavity 103. The lower housing assembly 12 defines the ventilation cavity 101 and the fresh air cavity 102. The upper housing assembly 11 may include an upper housing 111 and a lower housing 112. The upper housing 111 is provided above the lower housing 112. The air treatment assembly 4 is mounted in the lower housing 112. The indoor air outlet 106 is formed on the upper housing 111. The indoor air outlet 106 is formed on a front part of each of a left side wall and a right side wall of the upper housing 111, and is adapted to communicate the indoor space and the exhaust cavity 103. Therefore, the housing assembly 1 has a simple structure, and can be processed easily. Therefore, it is possible to facilitate machining the indoor air outlet 106 and a structure for mounting the air treatment assembly 4.

It can be understood that in the embodiments as described above, when the housing assembly 1 is disposed in the casing component 300, and the air outlet 302 is formed on the casing component 300, the indoor air outlet 106 is opposite to and in communication with the air outlet 302. When the housing assembly 1 may serve as the appearance surface of the air conditioning device 1000, the indoor air outlet 106 may serve as the air outlet 302.

In some embodiments, as illustrated in FIG. 4, and FIG. 7 to FIG. 9, the outdoor fresh air inlet 104 is formed at a rear side of the lower housing assembly 12. The indoor return air inlet 105 is formed at each of a left side and a right side of the lower housing assembly 12. The indoor air outlet 106 is formed at each of a left side and a right side of the upper housing assembly 11. Therefore, it is possible to ensure that the position of indoor exhaust air is far away from the position of the indoor return air, and the return air problem can be avoided. In addition, it is possible to increase the exhaust air area as much as possible and ensure the exhaust air requirements. In addition, it is possible to increase the inlet air area as much as possible and ensure the inlet air requirement. The present disclosure is not limited in this regard. For example, in other embodiments of the present disclosure, the indoor air outlet 106 may also be formed at a front side of the upper housing assembly 11. In addition, the number and the arrangement position of the outdoor fresh air inlet 104, the indoor return air inlet 105, and the indoor air outlet 106 may also be specifically adjusted as desired, so long as the ventilation requirements as described above are satisfied, and details thereof will be omitted herein.

In some embodiments, as illustrated in FIG. 5, the lower housing assembly 12 may be formed by assembling a plurality of sub-housings, to facilitate the assembling. For example, in some examples, the lower housing assembly 12 may be composed of a first housing 121, a second housing 122, a third housing 123, and a fourth housing 124 as described below. Therefore, it is possible to facilitate machining of the fresh air cavity 102 and the ventilation cavity 101. In addition, in some embodiments, it is also possible to facilitate mounting of the second valve assembly 32, the third valve assembly 33, and the fan assembly 2.

In some embodiments of the present disclosure, as illustrated in FIG. 4 and FIG. 5, the lower housing assembly 12 may include the first housing 121. The first housing 121 may be an integrated piece. The second valve assembly 32 may be mounted at the first housing 121, and the third valve assembly 33 may also be mounted at the first housing 121 simultaneously. Therefore, it is possible for the second valve assembly 32 and the third valve assembly 33 to be mounted on the same housing, i.e., on the first housing 121, to simplify assembly, facilitate wiring of a driver, and the like. For example, both the second driver 321 and the third driver may be mounted on the first housing 121, which may facilitate wiring of the second driver 321 and wiring of the third driver to improve tidiness and security of the wiring.

In some embodiments of the present disclosure, as illustrated in FIG. 4 and FIG. 5, the housing assembly 1 may further include the second housing 122. The second housing 122 is located at a rear side of the first housing 121, and is assembled with and connected to the first housing 121. The fresh air cavity 102 is defined by the second housing 122 and the first housing 121. The first housing 121 has a first opening 107 (i.e., the second outlet 101*d*) and a second opening 108 (i.e., the second inlet 101*b*). The first opening 107 is located above the second opening 108.

The upper part of the fresh air cavity 102 is in communication with the first opening 107, and the second valve assembly 32 is configured to control opening or closing of the first opening 107. When the first opening 107 is opened, the fresh air cavity 102 is in communication with the first opening 107, a front side of the fresh air cavity 102 is in communication with the second opening 108, and the third valve assembly 33 can control opening or closing of the second opening 108. When the second opening 108 is opened, the fresh air cavity 102 is in communication with the second opening 108.

Therefore, by forming the first opening 107 and the second opening 108 on the first housing 121 in the up-down direction, it is possible to ensure that mounting and operation of the second valve assembly 32 does not affect and interfere with mounting and operation of the third valve assembly 33. Therefore, a structure of the first housing 121 may be simplified to obtain a simple, compact, and small structure of the first housing 121 according to the embodiments of the present disclosure.

In some embodiments of the present disclosure, as illustrated in FIG. 4 and FIG. 5, the ventilation cavity 101 may include three cavities including a front cavity 1011, a rear cavity 1012 located at a rear side of the front cavity 1011, and an upper cavity 1013 located above the front cavity 1011 and the rear cavity 1012. A first outlet 101*c* is formed at an upper side of the upper cavity 1013 and is in communication with the exhaust cavity 103. The fan assembly 2 is disposed in the front cavity 1011. The housing assembly 1 further includes the third housing 123 and the fourth housing 124. The third housing 123 is located at a front side of the first housing 121, and is assembled with and connected to the first housing 121. The rear cavity 1012 is defined by the third housing 123 and the first housing 121. The fourth housing 124 is located at a front side of the third housing 123, and is assembled with and connected to the third housing 123. The front cavity 1011 is defined by the fourth housing 124 and the third housing 123. Therefore, the fourth housing 124 and the third housing 123 may be used as the volute casing of the fan assembly 2.

As illustrated in FIGS. 4 and 5, a third opening 109 located above the front cavity 1011 is formed between the fourth housing 124 and the third housing 123. The third opening 109 may be formed on at least one of the fourth housing 124 and the third housing 123. The upper cavity 1013 is defined by the first housing 121, the third housing 123, and the fourth housing 124. The upper cavity 1013 may be defined by the first housing 121 and the third housing 123, or may be defined by the first housing 121, the fourth housing 124, and the third housing 123.

In addition, in some embodiments of the present disclosure, each of the first housing 121, the second housing 122, the third housing 123, the fourth housing 124, the upper housing 111, and the lower housing 112 may be an integrated piece, which facilitates machining and assembly. Therefore, it is possible to enhance structural reliability of the housing assembly 1.

As illustrated in FIG. 4, a lower side of the front part of the upper cavity 1013 may be in communication with the third opening 109. Therefore, when the third opening 109 is in an open state, the upper cavity 1013 is in communication with the front cavity 1011. The rear of the upper cavity 1013 may be in communication with the first opening 107. Therefore, when the first opening 107 is in an open state, the upper cavity 1013 is in communication with the fresh air cavity 102. In this way, when the second valve assembly 32 opens the first opening 107, the air in the ventilation cavity 101 can flow into the fresh air cavity 102 through the front cavity 1011, the upper cavity 1013, and the first opening 107, to allow the air in the ventilation cavity 101 to be discharged into the fresh air cavity 102 when the second valve assembly 32 is in the open state.

In addition, in some cases, the air in the ventilation cavity 101 may also flow into the exhaust cavity 103 through the front cavity 1011 and the upper cavity 1013, enabling the air in the ventilation cavity 101 to be discharged to the exhaust cavity 103. Therefore, the housing assembly 1 has a simple, compact, and small structure, and a short and compact air flow path. In addition, it is possible to effectively implement switching of the plurality of functions as described above.

In some embodiments of the present disclosure, as illustrated in FIG. 5, and FIG. 7, to FIG. 9, the indoor return air inlet 105 is formed on each of a left side wall and a right side wall of the lower housing assembly 12. The indoor return air inlet 105 may be formed on at least one of the first housing 121 and the second housing 122. In addition, the indoor return air inlet 105 is located at the front side of the fresh air cavity 102 and may be in communication with the rear cavity 1012. Therefore, by forming the indoor return air inlet 105 and the third valve assembly 33 as described above, it is possible to ensure that when the third valve assembly 33 closes the second opening 108, the air supply from the indoor return air inlet 105 to the rear cavity 1012 of the ventilation cavity 101 will not be affected. As a result, the housing assembly 1 has a simple structure, which facilitates design and machining. In addition, the switching requirements of the foregoing functions may be effectively satisfied.

It should be noted that the first valve assembly 31, the second valve assembly 32, the third valve assembly 33, the fourth valve assembly 34, and the fifth valve assembly 35 are not limited to have only two states including the open state and the close state. For example, the first valve assembly 31, the second valve assembly 32, the third valve assembly 33, the fourth valve assembly 34, and the fifth valve assembly 35 may be configured to be adjustable in opening degree. For example, the first valve assembly 31, the second valve assembly 32, the third valve assembly 33, the fourth valve assembly 34, and the fifth valve assembly 35 may also have a semi-open state, or the like. Therefore, different usage requirements may be satisfied, and description thereof in detail will be omitted herein.

In addition, a specific construction, size, position, movement manner, and a number of a valve single body of the first valve assembly 31, the second valve assembly 32, the third valve assembly 33, the fourth valve assembly 34, and the fifth valve assembly 35 are not limited to the above description, and may also be specifically designed as desired, as long as the foregoing functional requirements can be satisfied, and details thereof will be omitted herein.

It should be noted that, an application scenario of the air treatment device 1000 according to the embodiments of the present disclosure is not limited in this regard. For example, the air treatment device 1000 may be used in an air conditioner, an air purifier, or the like, and details thereof will be omitted herein. As an example, the description will be provided below taking the air treatment device 1000 serving as an air conditioner.

As illustrated in FIG. 1, the air conditioning device 1000 is an air conditioner and may include an air heat exchanger 200 configured for temperature adjustment. Therefore, the air conditioning device 1000 according to the embodiments of the present disclosure may have an internal circulation function, a fresh air function, and an exhaust function to satisfy different user's demands.

It should be noted that a specific type of the air conditioner according to the embodiments of the present disclosure is not limited. For example, the air conditioner may be a split air conditioner or an all-in-one air conditioner. The split air conditioner may include an indoor unit and an outdoor unit. Both the air heat exchanger 200 and a fresh air component 100 may be provided in the indoor unit. The all-in-one air conditioner may be a mobile air conditioner, a window air conditioner, or the like.

It should be noted that an arrangement position of the fresh air component 100 on the air conditioning device 1000 is not limited. For example, in some embodiments of the present disclosure, when the fresh air component 100 is applied in a cabinet indoor unit, the fresh air component 100 may be provided at a lower side of a body of the cabinet indoor unit. In addition, it should be understood that the air heat exchanger 200 may include a heat exchanger and/or an electric auxiliary heater. In addition, when the air conditioning device 1000 is the air conditioner, the air conditioning device 1000 may further include an air duct component 400 configured to allow airflow to flow through the air heat exchanger 200, or the like, and the description thereof in detail will be omitted herein.

In some embodiments of this application, as illustrated in FIG. 1, and FIG. 10 to FIG. 12, the air conditioning device 1000 may further include a casing component 300. The air heat exchanger 200 and the fresh air component 100 are both received in the casing component 300. The air outlet 302 and the return air inlet 301 are formed on the casing component 300. The housing assembly 1 has an indoor return air inlet 106 and an indoor air outlet 105. The air outlet 302 is in communication with the indoor return air inlet 106. The return air inlet 301 is in communication with the indoor air outlet 105. The first valve assembly 31 includes a downstream control valve 3101. The downstream control valve 3101 is mounted on the casing component 300 and is adapted to control opening or closing of the air outlet 302. The second valve assembly 32 is mounted on the casing component 300. Therefore, ventilation requirements can be satisfied. In addition, the air heat exchanger 200 and the fresh air component 100 can be protected by using the casing component 300.

For example, as illustrated in FIG. 1, and FIG. 10 to FIG. 12, the casing component 300 may include a front panel 304, a rear casing 305, a bottom casing 306, a top casing 307, an air outflowing grille 308, and the like. The front panel 304 and the rear casing 305 are disposed at a front side and a rear side of the air outflowing grille 308, respectively. The air outlet 302 is formed on the air outflowing grille 308. A downstream control valve 3101 is provided at a position corresponding to the air outlet 302, and is configured to open or close the air outlet 302. The rear casing 305 is composed of one or more parts. The return air inlet 301 is formed on the rear casing 305, and a fourth valve assembly 34 is provided at the return air inlet 301. In addition, a heat exchange air inlet 3091 and a heat exchange air outlet 3092 that are in communication with the air duct component 400 may also be formed on the casing component 300.

In some embodiments of the present disclosure, a post is provided at two sides in the rear casing 305 and configured to mount and fix the air heat exchanger 200, the fresh air component 100, an electric control component, and the like. A guide sealing structure is disposed at an inner side of the rear casing 305, and is in guide slidable fit with the fresh air component 100 to facilitate the mounting of the fresh air component 100.

An air conditioning device 1000 according to an example of the present disclosure will be described below.

The air conditioning device 1000 includes a casing component 300, an air duct component 400, an air heat exchanger 200, and a fresh air component 100. The air duct component 400, the air heat exchanger 200, and the fresh air component 100 are all disposed in the casing component 300. The air duct component 400 includes a cross-flow fan. An air outlet 302, a return air inlet 301, a heat exchange air inlet 3091, and a heat exchange air outlet 3092 are formed on the casing component 300. A housing assembly 1 of the fresh air component 100 has an indoor return air inlet 105 and an indoor air outlet 106. The fresh air component 100 includes a fresh air pipe 5. The fresh air pipe 5 has an end formed as a fresh air inlet 303. A first valve assembly 31 is disposed at the air outlet 302. A second valve assembly 32 and a third valve assembly 3333 are disposed in the housing assembly 1 of the fresh air component 100. A fourth valve assembly 34 is disposed at the return air inlet 301. A fifth valve assembly 35 is disposed in the fresh air pipe 5.

In a heat exchange operation mode, the air duct component 400 is in operation, indoor air enters the casing component 300 through the heat exchange air inlet 3091, and is discharged into an indoor space through the heat exchange air outlet 3092 after exchanging heat with the air heat exchanger 200. Therefore, a temperature adjustment on the indoor air can be realized.

In a fresh air operation mode, as illustrated in FIG. 2, the first valve assembly 31 is in an open state, the second valve assembly 32 is in a close state, the third valve assembly 33 is in an open state, the fourth valve assembly 34 is in a close state, and the fifth valve assembly 35 is in an open state. When the centrifugal fan 21 operates, outdoor fresh air enters a fresh air cavity 102 through the fresh air pipe 5, and then enters a ventilation cavity 101 through the fresh air cavity 102. Then, the fresh air is discharged to an exhaust cavity 103 through the ventilation cavity 101, then is discharged out of the housing assembly 1 through the indoor air outlet 106 after treated by the air treatment assembly 4, and finally is discharged to the indoor space through the air outlet 302 on the casing component 300. Therefore, a fresh air function of introducing the fresh air into the indoor space from an outdoor space can be achieved.

In an internal circulation operation mode, as illustrated in FIG. 3, the first valve assembly 31 is in the open state, the second valve assembly 32 is in the close state, the third valve assembly 33 is in a close state, the fourth valve assembly 34 is in an open state, and the fifth valve assembly 35 is in a close state. When the centrifugal fan 21 is in operation, indoor air enters the casing component 300 through the return air inlet 301, and then enters the ventilation cavity 101 through indoor return air inlet 105. Then, the indoor air is discharged to the exhaust cavity 103 through the ventilation cavity 101, and then is discharged out of the housing assembly 1 through the indoor air outlet 106 after treated by the air treatment assembly 4. Finally, the indoor air is discharged into the indoor space through the air outlet 302 on the casing component 300. Therefore, an internal circulation function, in which the air is introduced from the indoor space and is then discharged to the indoor space after treated by the air treatment assembly 4, can be achieved.

In an exhaust operation mode, as illustrated in FIG. 4, the first valve assembly 31 is in a close state, the second valve assembly 32 is in an open state, the third valve assembly 33 is in the close state, the fourth valve assembly 34 is in the open state, and the fifth valve assembly 35 is in the open state. When the centrifugal fan 21 is in operation, the indoor air can enter the casing component 300 through the return air inlet 301, and then enters the ventilation cavity 101 through the indoor return air inlet 105, Then, the indoor air is discharged to the fresh air cavity 102 from the ventilation cavity 101, and is finally discharged to the outdoor space from the fresh air cavity 102 through the fresh air pipe 5. Therefore, it is possible to realize an exhaust function of introducing air from the indoor space and discharging the air into the outdoor space, to discharge stale air into the outdoor space.

Other arrangements and operations of the air conditioning device 1000 according to the embodiments of the present disclosure are known to those of ordinary skill in the art, and the description thereof in detail will be omitted herein.

In the description of the present disclosure, it should be understood that, orientations or position relationships indicted by terms such as "upper", "lower", "front", "back", "left", "right", and the like, are based on orientations or position relationships illustrated in the accompanying drawings, and is merely for the convenience of describing the present disclosure and simplifying the description, rather than indicating or implying that the associated device or element must have a specific orientation, or be constructed and operated in a specific orientation, and therefore is unable to be understood as a limitation on the present disclosure.

In addition, terms "first" and "second" are merely for descriptive purposes, and is unable to be understood as indicating or implying relative importance or implicitly indicating the number of indicated technical features. Therefore, the features associated with "first" and "second" may explicitly or implicitly include at least one of the features. In the description of the present disclosure, "a plurality of" means two or more, unless otherwise specifically defined.

In the present disclosure, unless otherwise clearly specified and limited, terms such as "install", "connect", "connect to", "fix" and the like should be understood in a broad sense. For example, it may be a fixed connection or a detachable connection or connection as one piece; direct connection or indirect connection through an intermediate; internal communication of two components or the interaction relationship between two components. For those skilled in the art, the specific meaning of the above-mentioned terms in the present disclosure may be understood according to specific circumstances.

In the present disclosure, unless expressly stipulated and defined otherwise, the first feature "on" or "under" the second feature may mean that the first feature is in direct contact with the second feature, or the first and second features are in indirect contact through an intermediate. In addition, the first feature "above" the second feature may mean that the first feature is directly above or obliquely above the second feature, or simply mean that the level of the first feature is higher than that of the second feature. The first feature "below" the second feature may mean that the first feature is directly below or obliquely below the second feature, or simply mean that the level of the first feature is smaller than that of the second feature.

In the description of this specification, descriptions with reference to the terms "an embodiment", "some embodiments", "examples", "specific examples", or "some examples" etc., mean that specific features, structure, materials or characteristics described in conjunction with the embodiment or example are included in at least one embodiment or example of the present disclosure. In this specification, the schematic representations of the above terms do not necessarily refer to the same embodiment or example. In addition, the described specific features, structures, materials or characteristics may be combined in any one or more embodiments or examples in a suitable manner. In addition, those skilled in the art can combine the different embodiments or examples and the features of the different embodiments or examples described in this specification without contradicting each other.

Although embodiments of the present disclosure have been illustrated and described, it is conceivable for those of ordinary skill in the art that various changes, modifications, replacements, and variations may be made to these embodiments without departing from the principles and spirit of the present disclosure. The scope of the present disclosure shall be defined by the claims as appended and their equivalent.

What is claimed is:

1. An air conditioning device comprising:

an air outlet adapted to be in communication with an indoor space;

a return air inlet adapted to be in communication with the indoor space;

a fresh air inlet adapted to be in communication with an outdoor space;

a fresh air cavity in communication with the fresh air inlet;

a ventilation cavity comprising:

an upper cavity; and a rear cavity;

an exhaust cavity in communication with the air outlet and the upper cavity;

a heat exchanger or heater disposed within the exhaust cavity;

a first valve assembly configured to control communication between the upper cavity and the air outlet;

a second valve assembly configured to control communication between the upper cavity and the fresh air cavity;

a third valve assembly configured to control communication between the fresh air cavity and the rear cavity; and a fourth valve assembly configured to control communication between the return air inlet and the rear cavity.

2. The air conditioning device according to claim 1, wherein:

the fresh air cavity is located at a rear side of the ventilation cavity; and the third valve assembly is disposed between a front of the fresh air cavity and a rear of the ventilation cavity and comprises a plurality of first vertical baffles sequentially arranged in a left-right direction.

3. The air conditioning device according to claim 1, wherein the first valve assembly is arranged downstream of the heat exchanger or heater.

4. The air conditioning device according to claim 3, wherein the first valve assembly is disposed at the air outlet and is configured to control opening or closing of the air outlet.

5. The air conditioning device according to claim 3, wherein the first valve assembly comprises a plurality of second vertical baffles sequentially arranged in a transverse direction of the air outlet.

6. The air conditioning device according to claim 1, wherein the first valve assembly is arranged upstream of the heat exchanger or heater.

7. The air conditioning device according to claim 6, wherein the first valve assembly is located below the heat exchanger or heater and comprises a plurality of first transverse baffles sequentially arranged in a front-rear direction.

8. The air conditioning device according to claim 1, wherein:

the fresh air cavity is located at a rear side of the ventilation cavity;

the exhaust cavity is located above the ventilation cavity;

a top of the upper cavity being in communication with the exhaust cavity through a first outlet, a rear of the upper cavity being in communication with an upper part of the fresh air cavity through a second outlet; and the second valve assembly is disposed at the second outlet and is configured to control opening or closing of the second outlet.

9. The air conditioning device according to claim 8, wherein the second valve assembly comprises a second transverse baffle.

10. The air conditioning device according to claim 8, wherein a centrifugal fan is disposed in the ventilation cavity.

11. The air conditioning device according to claim 10, wherein the centrifugal fan is disposed between the rear cavity and the upper cavity.

12. The air conditioning device according to claim 1, wherein the fourth valve assembly is disposed at the return air inlet and is configured to control opening or closing of the return air inlet.

13. The air conditioning device according to claim 1, further comprising a fifth valve assembly configured to control communication between the fresh air inlet and the fresh air cavity.

14. The air conditioning device according to claim 1, further comprising at least one treatment module adapted to be inserted into the exhaust cavity.

15. The air conditioning device according to claim 1, further comprising a housing assembly, wherein the housing assembly comprises an upper housing assembly and a lower housing assembly, wherein:

the upper housing assembly is disposed above the lower housing assembly and defines the exhaust cavity;

the lower housing assembly defines the ventilation cavity and the fresh air cavity; and the upper housing assembly comprises an upper housing and a lower housing, the upper housing being provided above the lower housing, the heat exchanger or heater being mounted in the lower housing, and the air outlet being formed on a front part of each of a left side wall and a right side wall of the upper housing.

16. The air conditioning device according to claim 1, further comprising a fresh air component comprising the fresh air cavity, the ventilation cavity, the exhaust cavity, the heat exchanger or heater, the second valve assembly and the third valve assembly.

17. The air conditioning device according to claim 16, further comprising a casing component comprising the air outlet and the return air inlet.

* * * * *